US009486381B2

(12) United States Patent
Juto et al.

(10) Patent No.: US 9,486,381 B2
(45) Date of Patent: Nov. 8, 2016

(54) ALS TREATMENT

(71) Applicant: CHORDATE MEDICAL AB, Kista (SE)

(72) Inventors: Fredrik Juto, Stockholm (SE); Jan-Erik Juto, Stockholm (SE); William Holm, Stockholm (SE); Viktor Kronestedt, Stockholm (SE)

(73) Assignee: CHORDATE MEDICAL AB, Kista (SE)

( * ) Notice: Subject to any disclaimer, the term of this patent is extended or adjusted under 35 U.S.C. 154(b) by 765 days.

(21) Appl. No.: 13/714,649

(22) Filed: Dec. 14, 2012

(65) Prior Publication Data

US 2013/0158451 A1 Jun. 20, 2013

Related U.S. Application Data

(60) Provisional application No. 61/576,832, filed on Dec. 16, 2011.

(51) Int. Cl.

| | |
|---|---|
| ***A61H 23/04*** | (2006.01) |
| ***A61H 1/00*** | (2006.01) |
| ***A61H 23/02*** | (2006.01) |

(52) U.S. Cl.

CPC ..... *A61H 1/00* (2013.01); *A61H 23/02* (2013.01); *A61H 23/04* (2013.01); *A61H 2201/5046* (2013.01)

(58) Field of Classification Search

CPC ..... A61M 25/10; A61M 25/1002; A61M 25/1011; A61M 2025/1015; A61M 25/1018; A61M 25/10184; A61M 25/10185; A61M 2025/102; A61M 2025/1022; A61M 2210/0618; A61M 2210/0681; A61H 21/00; A61H 2205/023; A61H 23/04

See application file for complete search history.

(56) References Cited

U.S. PATENT DOCUMENTS

| | | | |
|---|---|---|---|
| 901,376 | A | 10/1908 | Roberts |
| 912,205 | A | 2/1909 | Talcott |

(Continued)

FOREIGN PATENT DOCUMENTS

| | | | |
|---|---|---|---|
| CH | 329193 | A | 4/1958 |
| EP | 0935980 | A1 | 8/1999 |

(Continued)

OTHER PUBLICATIONS

Klinger et al., "Untersuchungen zur Mikro-zirkulation der Nasenschleimhaut bei Verwendung von Ballon-tamponaden", Laryngo-Rhino-Otol., vol. 76, 1997, pp. 127-130, XP008066107.

(Continued)

*Primary Examiner* — Justine Yu
*Assistant Examiner* — Michael Tsai
(74) *Attorney, Agent, or Firm* — Birch, Stewart, Kolasch & Birch, LLP

(57) ABSTRACT

A method for treating amyotrophic lateral sclerosis (ALS) in a human subject is provided. A first vibration stimulation member is introduced into a posterior part of a first nasal cavity of the human subject. By means of the first vibration stimulation member, vibrations are imparted to the posterior part of the first nasal cavity at frequency in a range of from 60 to 70 Hz. A second vibration simulation member is arranged between the trapezius muscle and the sternocleidomastoid muscle on a first side of the neck of the human subject; and by means of said second vibration stimulation member, vibrations are imparted to the first side of the neck at a frequency in a range of from 30 to 50 Hz.

11 Claims, 21 Drawing Sheets

(56) References Cited

U.S. PATENT DOCUMENTS

| | | | | |
|---|---|---|---|---|
| 961,034 | A | 6/1910 | Siebert et al. | |
| 1,735,519 | A | 11/1929 | Vance | |
| 1,764,838 | A | 6/1930 | Horne | |
| 2,052,321 | A | 8/1936 | Smart | |
| 2,101,273 | A | 12/1937 | Smith | |
| 3,055,371 | A * | 9/1962 | Kulick | A61M 25/02 600/546 |
| 3,209,755 | A * | 10/1965 | McCarthy | A61M 25/02 128/DIG. 26 |
| 3,612,211 | A | 10/1971 | Clark, III | |
| 3,848,607 | A | 11/1974 | St. Clair | |
| 4,343,303 | A * | 8/1982 | Williams | A61H 23/02 601/39 |
| 4,373,523 | A * | 2/1983 | Treutelaar | A61B 17/12 128/207.18 |
| 4,462,411 | A | 7/1984 | Rickards | |
| 4,593,688 | A * | 6/1986 | Payton | A61M 16/06 128/200.28 |
| 4,911,149 | A | 3/1990 | Borodulin et al. | |
| 5,139,510 | A | 8/1992 | Goldsmith, III et al. | |
| 5,609,606 | A | 3/1997 | O'Boyle | |
| 5,682,881 | A | 11/1997 | Winthrop et al. | |
| 5,755,225 | A * | 5/1998 | Hutson | A61M 16/0488 128/200.26 |
| 5,903,516 | A | 5/1999 | Greenleaf et al. | |
| 6,159,170 | A | 12/2000 | Borodulin et al. | |
| 6,193,680 | B1 | 2/2001 | Parsons et al. | |
| 6,358,272 | B1 | 3/2002 | Wilden | |
| 6,684,883 | B1 * | 2/2004 | Burns | A61M 16/0666 128/206.11 |
| 6,878,122 | B2 * | 4/2005 | Cordo | A61H 23/02 601/33 |
| RE41,376 | E * | 6/2010 | Torch | A61B 3/0066 340/573.1 |
| 8,317,816 | B2 | 11/2012 | Becker | |
| 8,499,762 | B2 * | 8/2013 | Couts | A61M 16/0666 128/200.24 |
| 8,612,010 | B2 * | 12/2013 | Simmons | A61H 1/0237 607/48 |
| 2001/0051819 | A1 | 12/2001 | Fischell et al. | |
| 2002/0072781 | A1 | 6/2002 | Lattner et al. | |
| 2002/0177889 | A1 | 11/2002 | Brisken et al. | |
| 2003/0087734 | A1 | 5/2003 | Kring et al. | |
| 2004/0049134 | A1 * | 3/2004 | Tosaya | A61H 23/0236 601/2 |
| 2004/0097850 | A1 | 5/2004 | Plante | |
| 2004/0172112 | A1 | 9/2004 | Cioanta et al. | |
| 2004/0230252 | A1 | 11/2004 | Kullok et al. | |
| 2004/0243172 | A1 | 12/2004 | Hogle | |
| 2005/0011518 | A1 | 1/2005 | Biondo et al. | |
| 2005/0021092 | A1 | 1/2005 | Yun et al. | |
| 2005/0054958 | A1 | 3/2005 | Hoffmann | |
| 2006/0094992 | A1 | 5/2006 | Imboden et al. | |
| 2006/0190022 | A1 | 8/2006 | Beyar et al. | |
| 2007/0149905 | A1 | 6/2007 | Hanna | |
| 2008/0198330 | A1 | 8/2008 | Taylor | |
| 2008/0200848 | A1 | 8/2008 | Avni | |
| 2008/0208168 | A1 | 8/2008 | Garabet | |
| 2008/0281238 | A1 | 11/2008 | Oohashi et al. | |
| 2009/0005713 | A1 | 1/2009 | Podrazhansky et al. | |
| 2009/0187098 | A1 | 7/2009 | Makower et al. | |
| 2010/0004709 | A1 | 1/2010 | Mische | |
| 2010/0094209 | A1 | 4/2010 | Drasler et al. | |
| 2010/0204749 | A1 * | 8/2010 | Thimineur | A61N 1/36071 607/45 |
| 2010/0228075 | A1 | 9/2010 | Lu | |
| 2010/0234840 | A1 | 9/2010 | Jackson et al. | |
| 2010/0249637 | A1 | 9/2010 | Walter et al. | |
| 2010/0274164 | A1 * | 10/2010 | Juto | A61H 9/0078 601/46 |
| 2010/0286576 | A1 | 11/2010 | Pryor et al. | |
| 2011/0190668 | A1 | 8/2011 | Mishelevich | |
| 2011/0270138 | A1 | 11/2011 | Mishelevich | |
| 2012/0253236 | A1 * | 10/2012 | Snow | A61N 7/00 601/2 |
| 2013/0092173 | A1 * | 4/2013 | Alexander | A61B 1/00108 128/207.18 |

FOREIGN PATENT DOCUMENTS

| | | | |
|---|---|---|---|
| FR | 592-104 | A | 7/1925 |
| FR | 838034 | A | 2/1939 |
| FR | 920885 | A | 4/1947 |
| GB | 385992 | A | 1/1933 |
| GB | 1217760 | A | 12/1970 |
| JP | 2001-17500 | A | 1/2001 |
| JP | 2001-37883 | A | 2/2001 |
| KR | 10-1019957 | B1 | 3/2011 |
| RU | 2099039 | C1 | 12/1997 |
| RU | 2199303 | C1 | 2/2003 |
| SU | 1148614 | A | 4/1985 |
| SU | 1560205 | A1 | 4/1990 |
| WO | WO 86/01399 | A1 | 3/1986 |
| WO | WO 96/36396 | A2 | 11/1996 |
| WO | WO 96/39218 | A1 | 12/1996 |
| WO | WO 01/41695 | A2 | 6/2001 |
| WO | WO 2004/047675 | A2 | 6/2004 |
| WO | WO 2004/105579 | A2 | 12/2004 |
| WO | WO 2006/114783 | A2 | 11/2006 |
| WO | WO 2008/138997 | A1 | 11/2008 |
| WO | WO 2010/033055 | A1 | 3/2010 |

OTHER PUBLICATIONS

Papon et al., "Nasal wall compliance in vasomotor rhinitis," J. Appl. Physiol., vol. 100, 2006 (First published Sep. 1, 2005), pp. 107-111, XP055055268.

Alstadhaug, "Migraine and the Hypothalamus", Cephalalgia, 2009, pp. 1-9.

Ansarinia et al., "Electrical Stimulation of Sphenopalatine Ganglion for Acute Treatment of Cluster Headaches", Headache, Jul. 2010, pp. 1164-1174.

Bar-Shir et al., "Late Stimulation of the Sphenopalatine-Ganglion in Ischemic Rats: Improvement in N-Acetyl-Aspartate Levels and Diffusion Weighted Imaging Characteristics as Seen by MR", Journal of Magnetic Resonance Imaging, vol. 31, 2010, pp. 1355-1363.

Brown et al., "Towards a Physiology-Based Measure of Pain: Patterns of Human Brain Activity Distinguish Painful from Non-Painful Thermal Stimulation", Plos One, vol. 6, Iss. 9, e24124, Sep. 2011, pp. 1-8.

Kim et al., "Predicting the Timing of Spikes Evoked by Tactile Stimulation of the Hand", J Neurophysiol, vol. 104, 2010, pp. 1484-1496.

Krajnak et al., "Characterization of Frequency-Dependent Responses of the Vascular System to Repetitive Vibration", JOEM, vol. 52, No. 6, Jun. 2010, pp. 584-594.

Kuncel et al., "Selection of Stimulus Parameters for Deep Brain Stimulation", Clinical Neurophysiology, vol. 115, 2004, pp. 2431-2441.

Leroux et al., "Cluster Headache", Orphanet Journal of Rare Diseases, vol. 3, No. 20, 2008, 11 pages provided.

Ludwig, "The Velocity of Sound through Tissues and the Acoustic Impedance of Tissues", The Journal of the Acoustical Society of America, vol. 22, No. 6, Nov. 1950, 5 pages provided.

Malm, "Measurement of Nasal Patency", Allergy, vol. 52 (suppl. 40), 1997, pp. 19-23.

Malm, "Stimulation of Sympathetic Nerve Fibres to the Nose in Cats", Acta Otolaryng, vol. 75, 1973, pp. 519-526.

Salansky et al., "Response of the Nervous System to Low Frequency Stimulation and EEG Rhythms: Clinical Implications", Neuroscience and Biobehavioral Reviews, vol. 22, No. 3, 1998, pp. 395-409.

Tepper et al., "Acute Treatment of Intractable Migraine With Sphenopalatine Ganglion Electrical Stimulation", Headache, vol. 49, Jul. 2009, pp. 983-989.

(56) References Cited

OTHER PUBLICATIONS

VBM, "VBM Tube Fixations", VBM Medizintechnik GmbH, 2006, 6 pages provided.

Zelena, "Nerves and Mechanoreceptors: The Role of Innervations in the Development and Maintenance of Mammalian Mechanoreceptors", Springer, 1994, pp. 147-148.

* cited by examiner

1: Vibration Stimulation Device
10: Anchoring Member
80: Control Unit
75: Monitoring Member 171: Text Fields
172: Confirmation Button
173: Stop Button 173: Stop Button
174: Pause Button
175: Progress Bar

ALS TREATMENT

CROSS-REFERENCE TO RELATED APPLICATIONS

This application claims priority under 35 U.S.C. §119(e) to U.S. Provisional Application No. 61/576,832 filed on Dec. 16, 2011. The entirety of the above-identified application is expressly incorporated herein by reference.

BACKGROUND OF THE INVENTION

1. Field of the Invention

The present invention relates to devices and methods for imparting low frequency vibrations to a tissue of a subject to affect the autonomic nervous system of the subject, for example in order to treat disorders related to the autonomic nervous system of the subject.

2. Description of Background Art

The nervous system comprises the central nervous system (CNS), i.e. the brain and the spinal cord, and the peripheral nervous system, i.e. the nerves and ganglia outside of the brain and spinal cord. The peripheral nervous system is in turn divided into the somatic nervous system and the autonomic nervous system (ANS). In general, the somatic nervous system is associated with the voluntary control of organs such as skeletal muscles, whereas the automatic nervous system is largely associated with the unconscious control of internal organs and homeostasis.

The ANS, also referred to as the visceral nervous system, controls a number of vital functions in the body, for example heart rate and force of the contractions of the heart, constriction and dilation of blood vessels, respiration rate, digestion, contraction and dilation of the stomach, intestine and colon, the diameter of the pupils, urination, perspiration, sexual arousal, secretion from exocrine and endocrine glands, etc.

This control is achieved by a system of sensory (afferent) neurons and motor (efferent) neurons that form a feedback loop from and to the internal organs. Sensory neurons convey information regarding the state of the environment and of the internal organs, e.g. carbon dioxide and oxygen levels in the blood, chemical content of the gut, blood pressure etc, to the CNS. Motor neurons, on the other hand, convey information from the CNS to target organs in order to regulate or modify their activity. Through this feedback loop the sensory information constantly and unconsciously modulate the activity of the motor neurons of the ANS and thus the activity of the internal organs.

The motor neurons are located in clusters called "autonomic ganglia". The efferent (motor) pathways of the ANS always involve two neurons; a myelinated preganglionic neuron that synapses onto an unmyelinated postganglionic neuron, the postganglionic neuron in turn innervating the target organ. A ganglion is a cluster of synapses between preganglionic and postganglionic neurons and comprises neural cell bodies and dendrites. The sensory neurons are also organized in similar ganglia.

The regulation and control of internal organs and of body homeostasis is also achieved through a balance between two subsystems of the ANS; the parasympathetic nervous system and the sympathetic nervous system. Most organs are affected by both these systems, which often have opposing, or rather complementary effects, on the organs. While the sympathetic nervous system is associated with arousal, energy, increased activity and decreased digestion, the parasympathetic nervous system is associated with rest, decreased activity and enhanced digestion.

There are several medical conditions related to dysautonomia, i.e. dysfunction of the ANS. Some of these are due to an imbalance between the sympathetic and the parasympathetic nervous systems, others have other causes. The symptoms may range from mild feelings of stress, fatigue, headaches, constipation and rapid heartbeats to stronger feelings of anxiety and dizziness. Severer diseases and syndromes include postural orthostatic tachycardia syndrome (POTS), inappropriate sinus tachycardia (IST), vasovagal syncope, mitral valve prolapse dysautonomia, pure autonomic failure, neurocardiogenic syncope (NCS), neurally mediated hypotension (NMH), orthostatic hypertension, autonomic instability and a number of lesser-known disorders such as cerebral salt-wasting syndrome. Other disorders associated with ANS malfunction include migraine, cluster headache, amyotrophic lateral sclerosis (ALS), Ménière's disease, Irritable Bowel syndrome (IBS), Crohn's disease, arteriosclerosis, ankylosing spondylitis (Bekhterev's disease), Sjögren's syndrome, torticollis, myotonic dystrophy, diabetes mellitus, ulcerative colitis, primary sclerosing cholangitis, asthma, inflammatory conditions of the distal colon, fibromyalgia, lumbago, and rheumatoid arthritis.

Management of conditions, symptoms and diseases depends on the severity of the symptom and the underlying cause. Some symptoms may be managed by adopting special diets, while others require medication. Often a combination of drugs is needed, commonly associated with unwanted side effects. There are also some known devices that have been developed in order to provide non-invasive and non-drug based methods for treating conditions related to the ANS. These are based on e.g. electrical stimulation, sound stimulation and ultrasonic stimulation.

Devices are known that by mechanical vibration affect tissue in a body cavity or over a body surface. In US 2008/0281238, a system for increasing activity on the fundamental brain is disclosed. The disclosed system comprises a first and a second vibration applying device, wherein the first vibration applying device applies vibrations having frequency components within an audible range to the auditory sense system of a living body. The second vibration applying device applies vibrations having super-high frequency components exceeding the audible range to another region of the body than the auditory sense system. The super-high frequency component of the second vibration increases the blood stream in the brain core and has the effect of enhancing the perception of the audible sound and improving the psycosomatic state of the patient.

in US 2010/0249637 A1 a device for treating restless leg syndrome is disclosed. The device comprises a sleeve to surround an arm or a leg of a patient and one or more vibration devices coupled to the sleeve. A motion sensing apparatus, in form of for example an accelerometer, an electroencephalography apparatus or an electromyography apparatus is used to monitor whether the arm or leg is about to move, in order to start the vibration stimulation before the patient becomes aware of the sensations that induces him or her to move his or her arm or leg.

US 2009/0005713 A1 discloses a method and device for using topically applied acoustic vibrations to treat different diseases and conditions. Low frequency vibrations are applied to the skin in order to stimulate production of adult stem cells.

in US 2002/0072781 A1 is shown and described e.g. various techniques for mechanical stimulation of vestibular nerves in the ear for the purpose of directly controlling respiratory system function. The stimulation can e.g. occur by an inflatable balloon exerting a static pressure on adjacent tissue. By varying the pressure, a certain sensation can be evoked. There is further shown and described another device for mechanical stimulation of nerves, which comprises a body that is vibrating at a certain frequency.

US 2004/0230252 A1 discloses a method and a device for affecting the ANS by a visual or audio stimulus. Information about the parasympathetic and/or sympathetic nervous system is obtained by monitoring the patient, and the information is used to continuously alter the stimuli according to the information obtained.

US 2005/0021092 A1 discloses a method of treating conditions related to abnormality in the ANS by increasing the parasympathetic activity/sympathetic activity ratio in a subject. An electrostimulatory device is used to stimulate an area in the parasympathetic nervous system and/or decrease the activity in the sympathetic nervous system. Information that is related to one or more aspects of the ANS is monitored before, during or after the electrical stimulation and the information may be used to trigger or modulate the stimulation.

SUMMARY OF THE INVENTION

It is an object of the present invention to provide novel devices and methods for affecting the autonomic nervous system of a subject.

Another object of the present invention is to provide novel devices and methods for treatment of conditions and diseases related to ANS dysfunction.

There is, in a first aspect of the present invention, provided a system for affecting the autonomic nervous system of a subject, said system comprises at least one vibration stimulation device configured to impart vibrations, in accordance with a treatment cycle, to a body tissue corresponding to a treatment site of the subject. The system also comprises a user interface, e.g. a graphical user interface, configured to receive and transmit input information related to a type of illness wherein the input information is received from at least one of an operator, the subject, and a database. Further, the system comprises a control unit which is configured to receive the input information transmitted by the user interface and to generate, based on the received input information, at least one treatment cycle comprising a frequency within a range of 10 to 100 Hz, a time average treatment pressure between the stimulation device and the tissue, wherein the treatment pressure is comprised within a range of 20 to 120 mbar, and a treatment site associated with a treatment target being a ganglion or a nerve of the ANS. The control unit is also configured to return the generated treatment site to the user interface, which is configured to display the returned treatment site, and to operate the vibration stimulation device according to the treatment cycle.

According to an embodiment, the type of illness is at least one of migraine, irritable bowel syndrome (IBS), amyotrophic lateral sclerosis (ALS), rhinitis, and hypertension.

In one embodiment, the type of illness is rhinitis. The treatment site may for example be the nasal cavity. The treatment cycle may comprise a frequency within the range of 50 and 70 Hz, and a time average treatment pressure within the range of for example 50 to 80 mbar. The input information may comprise illness symptoms such as stuffiness, itching, secretion, and sneezing.

In one embodiment, the type of illness is migraine. For such illness type, the treatment site may be the nasal cavity. The treatment cycle may comprise a frequency within the range of 60 and 70 Hz, and a time average treatment pressure within the range of for example 90 and 105 mbar. The input information may comprise illness symptoms related to for example experienced pain level, pain location, and elapsed time since a migraine attack started.

In one embodiment, the type of illness is hypertension. The treatment site for hypertension may be the nasal cavity. The treatment cycle may comprise a frequency within the range of 60 and 70 Hz, and a time average treatment pressure within the range of for example 90 and 105 mbar. The input information may comprise illness symptoms such as for example a measure of the blood pressure.

In one embodiment, the type of illness is irritable bowel syndrome (IBS). The treatment site may be located centrally over the abdomen, preferably over the umbilical region. The frequency of the treatment cycle may be comprised within the range of 30 and 50 Hz, and the time average treatment pressure may be comprised within the range of 20 and 60 mbar such as the range of 20 and 30 mbar. The input information may comprise illness symptoms such as bloating, constipation, diarrhea, experienced pain level, and pain location.

In a further embodiment wherein the type of illness is IBS the treatment site may be located on the skin above the celiac plexus. The frequency of the treatment cycle may be comprised within the range of 30 and 50 Hz, and the time average treatment pressure may be comprised within the range of 40 and 60 mbar. The input information may comprise illness symptoms such as bloating, constipation, diarrhea, experienced pain level, and pain location.

In yet another embodiment wherein the type of illness is IBS two treatment sites may be defined, e.g. the umbilical region and the celiac plexus as described above. Treatment may be administered sequentially to the two sites with the same or different stimulation members.

In one embodiment, the type of illness is IBS, and the treatment site the nasal cavity. The treatment cycle may comprise a frequency within the range of 50 and 90 Hz, and a time average treatment pressure within the range of for example 70 and 110 mbar. The input information may comprise illness symptoms such as bloating, constipation, diarrhea, experienced pain level, and pain location.

In one embodiment, the type of illness is IBS, and the treatment site the intestines. The treatment cycle may comprise a frequency within the range of 10 and 70 Hz, and a time average treatment pressure within the range of for example 20 and 50 mbar. The input information may comprise illness symptoms such as bloating, constipation, diarrhea, experienced pain level, and pain location.

In one embodiment, the type of illness is amyotrophic lateral sclerosis (ALS). The treatment site may be the nasal cavity. The treatment cycle may comprise a frequency within the range of 60 and 70 Hz, and a time average treatment pressure within the range of for example 90 to 105 mbar. The input information may comprise illness symptoms such as a difficulty swallowing, a difficulty breathing, muscle weakness in a leg, fasciculation frequency and muscle weakness in an arm.

In one embodiment, the type of illness is ALS and the treatment site the neck, preferably between the trapezius muscle and the sternocleidomastoid muscle (occipital triangle). The treatment cycle may comprise a frequency within the range of 30 and 50 Hz, and a time average treatment pressure within the range of for example 40 to 60 mbar. The input information may comprise illness symptoms such as a difficulty swallowing, a difficulty breathing, muscle weakness in a leg, and muscle weakness in an arm.

In one embodiment, the input information further comprises at least one of age, gender, race, weight, length, and identity.

In one embodiment, the system comprises a plurality of different types of vibration stimulation devices configured for vibration treatment on different treatment sites of the subject.

In one embodiment, the control unit is configured to determine, based on the treatment site, and/or optionally based on the type of illness, which type(s) of vibration stimulation device(s) to be used for vibration treatment and transmit information regarding the determined type(s) of vibration stimulation device(s).

In one embodiment, the treatment site is the nasal cavity and the vibration stimulation device is of a type that can be arranged in a first state wherein the stimulation device can be introduced via a body opening into the nasal cavity, and a second state wherein the stimulation device is expanded to a volume such that the stimulation device abuts against the tissue within the nasal cavity.

In one embodiment, the treatment site is centrally over the abdomen or the neck, preferably between the trapezius muscle and the sternocleidomastoid muscle (occipital triangle), and the type of vibration stimulation device has the shape of a balloon, a bag, a pouch, or a membrane.

In one embodiment, the treatment site is the intestines and the vibration stimulation device is of a type that can be arranged in a first state wherein the stimulation device can be introduced via a body opening into the intestine, and a second state wherein the stimulation device is expanded to a volume such that the stimulation device abuts against the tissue within the intestine.

In one embodiment, the treatment cycle further comprises at least one of type of stimulation device, treatment duration, threshold (or target) value, vibration pattern, and amplitude of the vibrations. The treatment cycle may for example be based on a previously conducted vibration treatment, an identity associated with the patient, or a predefined treatment cycle.

In one embodiment, the system further comprises a monitoring member configured to receive and transmit input data reflecting a measure of activity in the ANS of the subject. The control unit is further configured to receive the input data, and to perform one of adjusting, based on the input data, the at least one treatment cycle, comparing the input data with a predefined target value and abort the vibration treatment if the target value is reached, or comparing the input data with a predefined target value and prolong the vibration treatment with a predefined time interval if the target value is reached. Preferably, the control unit is configured to modulate the treatment cycle dependent on the input data received by the monitoring member, e.g. such that the effect of the vibrations on said measure is maximized. The control member may for example comprise software implementing an algorithm that, dependent on the input data, is configured to control the modulation of the vibration parameters of the treatment cycle. Such algorithms may include a grid search algorithm, a gradient search algorithm and a heuristic search algorithm.

Vibratory stimulation of tissues that are proximate to or connected with ganglia of the ANS, to the hypothalamus or to other nerves or nerve fibers of the ANS with a device according to the first aspect thus affects ANS activity. The activity in the ANS can be measured directly or indirectly by different qualitative and/or quantitative methods. In particular, changes in physiological parameters such as for example blood pressure, pupil size, neural activity, muscle activity and heart rate are correlated to changes in the level of ANS activity. Such physiological parameters can thus be used as measures of ANS activity. Some measures can be monitored directly, such as by means of functional neuroimaging; and some indirectly, such as by means of different bodily responses, e.g. pupil size and heart activity.

The purpose of monitoring is to make sure that the treatment is effective. The monitoring member provides a way to get information on the effects of the treatment on the activity of the ANS and to use that information to adjust the treatment if needed. Depending on the purpose of the treatment, e.g. to cure a disease, alleviate symptoms or just calm or arouse the subject, the goal of the treatment is to either increase or decrease the activity of the ANS and the particular ganglion involved. In some cases both increased and decreased activity may be desired. The treatment may be adjusted by changing a vibration stimulation parameter of the treatment cycle, e.g. vibration frequency, vibration amplitude, vibration duration and/or the pressure between the stimulation member and the stimulated tissue. The adjustment may be carried out manually or automatically, e.g. by the control unit.

In one embodiment the input data received by the monitoring member is related to the pressure between said tissue and said vibration stimulation device, the electrical conductivity of said tissue, the compliance in said tissue, the pupil size of the subject, an electroencephalographic (EEG) signal derived from the subject, an electromyographic (EMG) signal derived from the subject, an electrocardiographic (ECG) signal derived from the subject, a photoplethysmographic signal related to blood flow, blood volume, heart rate, heart rate variability, blood volume pulse and/or blood oxygen level, the blood pressure of the subject and/or the body temperature of said subject.

In one embodiment, the system comprises a storage unit configured to store the input data reflecting a measure of activity in the ANS.

In one embodiment, the control unit is further configured to determine a value representing a minimum of activity in the ANS by comparing received input data with stored input data from previously conducted treatments.

In one embodiment, the target value is set to a fraction of a value representing initial input data.

In one embodiment, the monitoring member is at least partly integrated into the vibration stimulation device.

The system of the present invention may further comprise an anchoring member configured for anchoring the vibration stimulation device to the subject such that the vibration stimulation device abuts against the tissue of said subject, preferably with a desired pressure. The anchoring member is for example a headband, a facial mask, a pair of glasses, a belt, a cuff, a vest, an adhesive patch, an inflatable cuff, or an inflatable belt.

Furthermore, the monitoring member may be at least partly integrated into the anchoring member or may be at least partly integrated into the vibration stimulation device.

In still another embodiment the system further comprises a localizing member for localizing, in the subject, a target site for vibration stimulation. The target site is a target ganglion, a target nerve, or a target nerve fiber of the ANS. Such target site may for instance be localized by an ultrasonic scanner, a functional magnetic resonance imaging (fMRI) scanner and/or a positron emission tomography (PET) scanner.

In one embodiment, the localizing member is further configured to transmit the treatment target site to the control unit which is configured to generate the at least one treatment cycle based on the received treatment target location, the received type of illness, or a combination thereof.

In one embodiment, the user interface is further configured to receive a position input from an operator or the subject confirming the position of the vibration stimulation device at the treatment site, and to transmit the position input to the control unit.

In one embodiment, the control unit is further configured to generate and transmit information comprising instructions regarding how to apply an anchoring member. The user interface may be further configured to receive and display the instructions. The user interface may also be configured to display a graphical object representing a treatment cycle or parameters related to the treatment, such as e.g. a progress bar illustrating the treatment duration.

In a second aspect, there is provided a method for affecting the autonomic nervous system of a subject, comprising the steps of providing a vibration stimulation device configured to impart vibrations to a body tissue corresponding to a treatment site of the subject, the vibrations being imparted according to a treatment cycle, and providing input information comprising type of illness. The method further comprises generating, based on the provided type of illness, at least one treatment cycle having a frequency comprised within a range of 10 to 100 Hz, a pressure between the stimulation device and the tissue, which pressure is comprised within a range of 20 to 120 mbar, and a treatment site associated with a treatment target being a ganglion or a nerve of the ANS.

The method may also comprise the steps of selecting a treatment site of said subject, anchoring a vibration stimulation device such that it abuts against said treatment site, and transmitting vibrations from said vibration stimulation device to said treatment site, said vibrations having a frequency of 10 to 100 Hz.

In one embodiment, the type of illness is at least one of migraine, IBS, ALS, and rhinitis.

In one embodiment, the generating of at least one treatment cycle comprises using a look-up table to find a treatment cycle for the type of illness.

In one embodiment, the method further comprises receiving input data reflecting a measure of activity in the ANS of the subject and which input data is collected by a monitoring member during a previous conducted vibration treatment, and adjusting, based on the input data, the at least one treatment cycle according to an automated algorithm which may be selected from a grid search algorithm, a gradient search algorithm, and a heuristic search algorithm.

In one embodiment, the input data reflect a measure of activity in the ANS of the subject during the vibration treatment.

In another embodiment, the input data reflect a measure of activity in the ANS of the subject prior to the vibration treatment.

In one embodiment the monitored measure relates to a parameter selected from the pressure between said tissue and said vibration stimulation device, the electrical conductivity of said tissue, the compliance in said tissue, the pupil size of the subject, an electroencephalographic (EEG) signal derived from the subject, an electromyographic (EMG) signal derived from the subject, an electrocardiographic (ECG) signal derived from the subject, a photoplethysmographic signal related to blood flow, blood volume, blood volume pulse and/or blood oxygen level, the blood pressure of the subject and/or the body temperature of said subject.

In one embodiment the method further comprises, prior to the step of selecting a treatment site, the step of localizing a treatment target, said target being a ganglion, a nerve, or a nerve fiber of the autonomous nervous system. The target ganglion, nerve, or nerve fiber may for instance be a ganglion, nerve, or nerve fiber wherein a disorder in the autonomic nervous system has been manifested. The treatment site is then selected in order to achieve an effect at the selected treatment target. The treatment target may for instance be localized using an ultrasonic scanner, a functional magnetic resonance imaging (fMRI) scanner and/or a positron emission tomography (PET) scanner.

In one embodiment, the subject suffers from an illness selected from migraine, rhinitis, hypertension, ALS, and IBS.

In a third aspect, there is provided a method for treating amyotrophic lateral sclerosis (ALS) in a human subject comprising the steps of introducing a first vibration stimulation member into a posterior part of a first nasal cavity of the human subject, by means of the first vibration stimulation member imparting vibrations to the posterior part of the first nasal cavity at frequency in a range of from 60 to 70 Hz, arranging a second vibration simulation member between the trapezius muscle and the sternocleidomastoid muscle on a first side of the neck of the human subject and, by means of the second vibration stimulation member, imparting vibrations to the first side of the neck at a frequency in a range of from 30 to 50 Hz.

In one embodiment the step of imparting vibrations by means of the first stimulation member is conducted prior to the step of imparting vibrations by means of the second stimulation member. In another embodiment the step of imparting vibrations by means of the first stimulation member is conducted concurrently with the step of imparting vibrations by means of the second stimulation member.

The step of arranging may further comprise the step of applying a collar around the second vibration stimulation member and around the neck of the human subject.

In one embodiment a time averaged pressure within the first vibration stimulation member during the imparting of vibrations by means of the first vibration stimulation member is in the range of from 90 to 105 mbar.

In one embodiment a time averaged pressure within the second vibration stimulation member during the imparting of vibrations by means of the second vibration stimulation member is in the range of from 40 to 60 mbar.

The step of introducing may further comprise the step of anchoring the first vibration stimulation member to the head of the human subject by means of at least one of a headband, a facial mask, a pair of glasses, and a helmet.

In one embodiment the second vibration stimulation member has a diameter in the range of from approximately 50 to approximately 100 mm.

The step of introducing may comprise the steps of introducing the first vibration stimulation member into the nasal cavity in an essentially non-expanded state, and expanding the first vibration stimulation member within the nasal cavity such that it abuts nasal cavity tissue.

In one embodiment of the third aspect of the invention the method further comprises the steps of introducing the first vibration stimulation member into a second nasal cavity and, by means of the first vibration stimulation member, imparting vibrations to a posterior part of a second nasal cavity at frequency in the range of from 60 to 70 Hz.

In one embodiment the method further comprising the steps of arranging the second vibration stimulation member the between trapezius muscle and the sternocleidomastoid muscle on a second side of the neck of the human subject and, by means of the second vibration stimulation member, imparting vibrations to the second side of the neck at a frequency in the range of from 30 to 50 Hz.

In one embodiment the duration of the imparting of vibrations to the nasal cavity and/or the neck is in the range of 10 to 20 minutes.

In a fourth aspect, there is provided a method for treatment of ALS in a human subject comprising the steps of, by means of a vibration stimulation member, imparting vibrations to a nasal cavity of the human subject if the human subject shows symptoms of muscle weakness affecting a leg and/or imparting vibrations to a location on the neck of the human subject if the human subject shows symptoms of having difficulty in speaking or in swallowing and/or imparting vibrations to an upper arm of the human subject if the human subject suffers from muscle weakness affecting an arm.

In an embodiment wherein the vibrations are imparted to the nasal cavity, the method may further comprise the steps of introducing an essentially non-expanded first vibration stimulation member into the nasal cavity of the human subject, expanding the first vibration stimulation member within the nasal cavity such that the first vibration stimulation member abuts tissue in a posterior part of the nasal cavity and, by means of the first vibration stimulation member, imparting vibrations to the posterior part of the nasal cavity at a frequency in the range of from 60 to 70 Hz.

In an embodiment wherein the vibrations are imparted to the neck, the method may further comprise the steps of arranging a second vibration stimulation member on a position of the neck of the human subject between the trapezius muscle and the sternocleidomastoid muscle and, by means of the second vibration stimulation member, imparting vibrations to the position of the neck at a frequency in the range of from 30 to 50 Hz.

In one embodiment a time average pressure within the first vibration stimulation member during the imparting of vibrations is in the range of from 90 to 105 mbar.

In one embodiment the first vibration stimulation member is expandable and has a lateral extension in the range of from approximately 50 to approximately 100 mm.

In one embodiment a time averaged pressure within the second vibration stimulation member during the imparting of vibrations is in the range of from 40 to 60 mbar.

In an embodiment wherein vibrations are imparted to the upper arm, the method may further comprise the steps of providing a third vibration stimulation member in the form of a cuff, arranging the third vibration stimulation member around the upper arm of the human subject and, by means of the third vibration stimulation member, imparting vibrations to the upper arm at a frequency in the range of from 30 to 50 Hz.

In one embodiment a time average pressure within the third vibration stimulation member during the imparting of vibrations is in the range of from 20 to 50 mbar.

In a fifth aspect, there is provided a method for treatment of gastrointestinal disease comprising, by means of a vibration stimulation member, imparting vibrations to a nasal cavity if a human subject shows symptoms of constipation alone and/or imparting vibrations to an abdomen if the human subject shows symptoms of one or more of bloating, abdominal pain, diarrhea, constipation, or tenesmus and/or imparting vibrations to intestines if the human subject shows symptoms of an inflammatory condition.

In one embodiment of the fifth aspect wherein the vibrations are imparted to the abdomen, the method may further comprise the steps of providing a first vibration stimulation member and, by means of the first vibration stimulation member, imparting vibrations to skin in a region of a celiac plexus of the human subject at a frequency in the range of from 30 to 50 Hz, providing a second stimulation member and by means of the second vibration stimulation member, imparting vibrations to skin of an umbilical region of the human subject at a frequency in the range of from 30 to 50 Hz.

In one embodiment a weight is arranged on the first vibration stimulation member and the second vibration stimulation member respectively, such that the members impart a pressure on the skin of the human subject. The weight may for example have a mass in the range of from approximately 1 to approximately 3 kg.

In one embodiment a time averaged pressure within the first vibration stimulation member during the imparting of vibrations by means of the first vibration stimulation member is in the range of 40 to 60 mbar.

In one embodiment a time averaged pressure within the second vibration stimulation member during the imparting of vibrations by means of the second vibration stimulation member is in the range of from 20 to 30 mbar.

In one embodiment the first vibration stimulation member has a diameter in the range of from approximately 50 to approximately 100 mm.

In one embodiment the second vibration stimulation member has a diameter in the range of from approximately 150 to approximately 250 mm.

In one embodiment of the fifth aspect wherein the vibrations are imparted to the nasal cavity, the method may further comprise the steps of introducing an expandable stimulation member into the nasal cavity, inflating the stimulation member to abut tissue within the nasal cavity and imparting vibrations to the tissue within the nasal cavity, by means of the expandable stimulation member, at a frequency in the range of from 60 to 70 Hz.

In one embodiment a time average pressure within the expandable stimulation member during the imparting of vibrations is in the range of from 70 to 120 mbar.

In another embodiment a time average pressure within the expandable stimulation member during the imparting of vibrations is in the range of from 90 to 105 mbar.

In one embodiment of the fifth aspect wherein the vibrations are imparted to the intestines, the method further comprising the steps of introducing an expandable stimulation member in the intestines via the rectum, inflating the stimulation member to abut tissue within the intestines and imparting vibrations to the tissue within the intestines, by means of the expandable stimulation member, at a frequency in the range of from 10 to 70 Hz.

In one embodiment a time average pressure within the expandable stimulation member during the imparting of vibrations is in the range of from 20 to 50 mbar.

The gastrointestinal disease is in one embodiment irritable bowel syndrome (IBS). The gastrointestinal disease is in another embodiment at least one of gastritis, pancreatitis, gastric dumping syndrome, diabetes, Crohn's disease, ulcerative colitis, sclerosing cholangitis, or inflammatory bowel disease (IBD).

In a sixth aspect, there is provided a method for treatment of gastrointestinal disease in a human subject comprising the steps of providing a first vibration stimulation member and, by means of the first vibration stimulation member, imparting vibrations to skin in region of a celiac plexus of the human subject at a frequency in the range of 30 to 50 Hz, providing a second stimulation member and, by means of the second vibration stimulation member, imparting vibrations to skin of an umbilical region of the human subject at a frequency in the range 30 to 50 Hz.

In one embodiment of the sixth aspect a time averaged pressure within the first vibration stimulation member during the imparting of vibrations by means of the first vibration stimulation member is in the range of 40 to 60 mbar.

In one embodiment of the sixth aspect a time averaged pressure within the second vibration stimulation member during the imparting of vibrations by means of the second vibration stimulation member is in the range of 20 to 30 mbar.

It should be understood that embodiments and examples described in relation to the system aspect of the present invention are equally relevant, when applicable, to the method aspects of the present invention, and vice versa.

BRIEF DESCRIPTION OF THE DRAWINGS

Referring now to the Figures, which are exemplary embodiments, and wherein the like elements are numbered alike.

DETAILED DESCRIPTION OF THE PREFERRED EMBODIMENTS

ANS

Figure 1A:
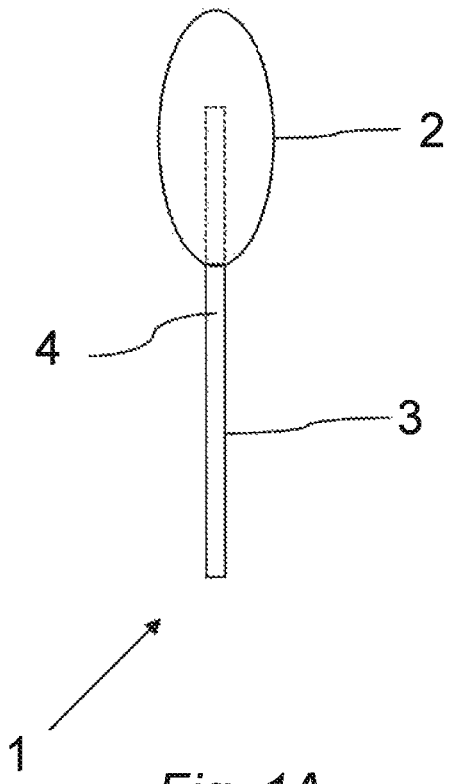
FIGS. 1A-B, 2A-B, and 3 are schematic representations each depicting an example of a vibration stimulation device according to the present invention.

The present invention relates to the finding that mechanical vibrations of low frequency (10-100 Hz) imparted onto tissues that are connected to or in proximity of ganglia, nerves, nerve fibers of the ANS or the hypothalamus affects the activity of that ganglion, nerve, nerve fiber or hypothalamus. Mechanical vibration stimulation of tissues that are close to or connected with ganglia of the ANS, to the hypothalamus or to other nerves or nerve fibers of the ANS may increase or decrease the activity in the ANS. The present invention is directed towards affecting a subject's ANS, whether to treat a disease or condition, or to simply modulate the performance of the ANS as desired. The invention relates to a device and method that involves imparting mechanical vibrations onto a treatment site, i.e. a tissue that is connected to the ANS; using a monitoring member to obtain a measure or information of the activity in the ANS as a result of the stimulation; and optionally using that measure or information to modulate the vibration stimulation in order to achieve the desired, optimum or maximum effect.

For the purpose of the present invention the ANS is meant to include the sympathetic and the parasympathetic nervous systems as well as the enteric nervous system.

Target of the vibration stimulation is one or more ganglia, nerves, or nerve fibers of the ANS or the hypothalamus. The vibrations are however not imparted directly onto the selected target ganglion or hypothalamus, but are imparted onto a treatment site of a tissue that is connected to the selected target ganglion or hypothalamus. The vibrations thus affect the target ganglion or hypothalamus indirectly and by unknown mechanism, possibly by mechanical transfer of the vibrations through the tissues that lie between the treatment site and the target ganglion or hypothalamus.

The communication path between the vibration stimulated treatment site and the ganglion or hypothalamus is not completely understood. However, the human body has different cell types to detect and communicate mechanical influence, so called mechanoreceptors. There are four main types of mechanoreceptors in the human body: Pacinian corpuscles, Meissner's corpuscles, Merkel's discs, and Ruffini corpuscles. Pacinian corpuscles (also known as lamellar corpuscles) detect rapid vibrations (200-300 Hz). Meissner's corpuscles (also known as tactile corpuscles) detect changes in texture (vibrations around 50 Hz) and adapt rapidly. Merkel's discs (also known as Merkel nerve endings) detect sustained touch and pressure and adapt slowly. Ruffini corpuscles (also known as Ruffini's end organs, bulbous corpuscles, and Ruffini endings) are slowly adapting receptors that detect tension deep in the skin. The majority of knowledge about the mechanoreceptors comes from studies performed on the skin. Less is known about how the receptors react in the nasal mucosa or when they are attached to the cranial bones or when present at other sites of the body.

It is conceivable that the frequency content of the vibration stimulation should be tuned to match the response of some of the mechanoreceptors to obtain the desired therapeutic effect. There is some indirect evidence for this hypothesis in that there is a clear change in patient response when the frequency is varied. This can be interpreted as an excitation of a resonance within the body.

All ganglia of the ANS may be targets for vibration stimulation according to the present invention. By way of examples the sphenopalatine ganglion, the ganglia of the solar plexus and the paravertebral ganglia will be discussed in some more detail.

The sphenopalatine ganglion (also named the pterygopalatine ganglion, meckel's ganglion or the nasal ganglion) is one of four parasympathetic ganglia found in the head and neck. It is located in the pterygopalatine fossa of the skull. The sphenopalatine ganglion regulates the flow of blood to the nasal mucosa and heats or cools the air in the nose. The sphenopalatine ganglion may be affected through vibration stimulation of the nasal cavity.

The solar plexus (also denoted celiac plexus or coeliac plexus) is a complex network of nerves located in the abdomen, between the stomach and the diaphragm. The solar plexus comprises the celiac ganglia and the aorticorenal ganglion, as well as a network of other nerves, e.g. the splanchnic nerves and parts of the right vagus nerve, and other interconnecting fibers. The two celiac ganglia (also referred to as coeliac ganglia, semilunar ganglia or solar ganglia) are located in the upper region of the abdomen and is part of the sympathetic nervous system. The unmyelinated postganglionic axons of these ganglia innervate most of the digestive tract, e.g. the stomach, liver, gallbladder, spleen, kidney, small intestine, colon and the ovaries. The aorticorenal ganglion lies in close proximity to the celiac ganglia and may be partly fused with these. The ganglia as well as the splanchnic nerves, the vagus nerve and other nerve fibers of the solar plexus may be affected by vibration stimulation of selected sites of the anterior part of the torso.

The paravertebral ganglia (also denoted ganglia of the sympathetic trunk) are located along the length of the spine, from the base of the skull to the tailbone. The paravertebral ganglia are divided into three cervical ganglia, twelve thoracic ganglia, five lumbar ganglia and four sacral ganglia. They comprise nerve cells that innervate different internal organs of the thorax and abdomen. The paravertebral ganglia and their nerve fibres plexus may be affected by vibration stimulation of selected sites of the posterior part of the torso, i.e. the back, along the length of the spine.

IBS

Irritable bowel syndrome (IBS) is a common functional gastrointestinal disorder characterised by abdominal pain, abdominal discomfort and disturbed defecation. The disease can be divided into two subgroups; diarrhoea-predominant IBS and constipation-predominant IBS. Currently, there does not seem to exist any effective treatments for the entire syndrome complex, and the choice of treatment is based on existing symptoms. The pathophysiological mechanism(s) involved in IBS seems to remain unknown, but the pathophisiology is most likely multifactoral. Several hypotheses have been proposed, e.g. abnormal GI motor function, visceral hypersensitivity, autonomic dysfunction, and altered microbiotome, just to mention a few. Furthermore, there is evidence suggesting involvement of serotonin disequilibrium in the pathophysiology of IBS. However, the cause of IBS seems to remain obscure.

ALS

Amyotrophic lateral sclerosis (ALS) is a fatal neurodegenerative disease affecting both upper and lower motor neurons. The disease is characterized by progressive weakness, muscle atrophy, fasciculation, spasticity, dysarthria and respiratory comprise. However, the disease is heterogeneous and the onset point as well as the survival time differs between individuals. No cure seems to exist and symptomatic treatments improving quality of life serves as the primary treatment approach. The pathophysiological mechanism(s) remains for the most part unknown. However, the disease is believed to be multifactoral involving genetics as well as cellular pathways. Other examples of hypotheses linked to ALS are; motor system developmental disorders caused by viral infections, insufficient release of neurotropic factors, altered expression of glutamate receptors, and TDP-43 production. Furthermore, autonomic nervous system dysfunctions might play a role. Two thirds of the spinal cord (including the ventral horn) is supplied by the anterior spinal artery alone. Small alterations of this vessel or involved circulation could therefore affect a large portion of the human motor system. This fact has not yet been linked to ALS development. However, this hypothesis ought to be investigated.

Hypertension

The pathophysiological mechanism(s) involved in hypertension is not completely understood. However, several interrelated factors are most likely involved in the establishment of this condition. The renin-angiotensin system (proposed to be the most important endocrine system involved in blood pressure regulation), endothelial dysfunction and neurogenic mechanisms are some areas that are hypothesized to play vital roles in this process. The sympathetic nervous system is of importance for blood pressure regulation and over-activity in sympathetic nerves has been proposed to be involved in hypertension. Furthermore, human and animal data link autonomic modulation and increased blood pressure to inflammatory processes in cardiovascular regions of the brain. All in all, the mechanism(s) behind the pathophysiology of hypertension remains mostly unknown, but several lines of evidence may suggest that several interrelated factors are involved in this process.

Vibration Stimulation Device

The vibration stimulation device of the present invention is configured to vibrate and to impart or transfer its vibrations onto a tissue of the patient or subject to be treated. The vibration stimulation device may be configured to be operated in accordance with a treatment cycle comprising e.g. vibration frequency and amplitude, treatment pressure, treatment duration, etc. The patient or subject to be treated may be a human, a mammal or a vertebrate animal, i.e. a tetrapod. The vibration stimulation device comprises a stimulation member that is configured to abut against the tissue of the patient and a vibration member for bringing the stimulation member to vibrate. In some embodiments the stimulation member is separate from the vibration member, while in other embodiments the vibration member also functions as a stimulation member and directly imparts the vibrations onto the tissue of the subject. The stimulation member is made of a material that is able to vibrate at frequencies in a range of 10-100 Hz, or sub-intervals thereof (see below) and that is able to transfer those frequencies to the tissue of the subject.

An example of a vibration stimulation device is shown in FIG. 1A. The shown vibration stimulation device 1 is arranged for imparting vibrations onto tissues located within a body cavity, such as the cavities of the nose or the intestines. It comprises an expandable stimulation member 2 that is arranged to be introduced into a body cavity and to abut against the tissue of the body cavity. The stimulation member 2 has an inner chamber for receiving fluid. In the shown example the stimulation member 2 is in the shape of a balloon. An expansion member 3 with a channel 4 is configured to supply fluid to the stimulation member 2. The supply of fluid to the stimulation member 2 via the expansion member 3 influences the volume and degree of expansion of the stimulation member.

The supply of fluid, e.g. a gas or a liquid, may be controlled by an external apparatus via the expansion member. Such an external apparatus may comprise a cylinder with a movable plunger that, by moving back and forth, can regulate the amount of fluid in the cylinder and thereby regulate the amount of fluid in the expansion member.

Vibration stimulation devices of the type shown in FIG. 1A have been further described in WO 2008/138997, which is incorporated herein by reference.

Figure 1B:
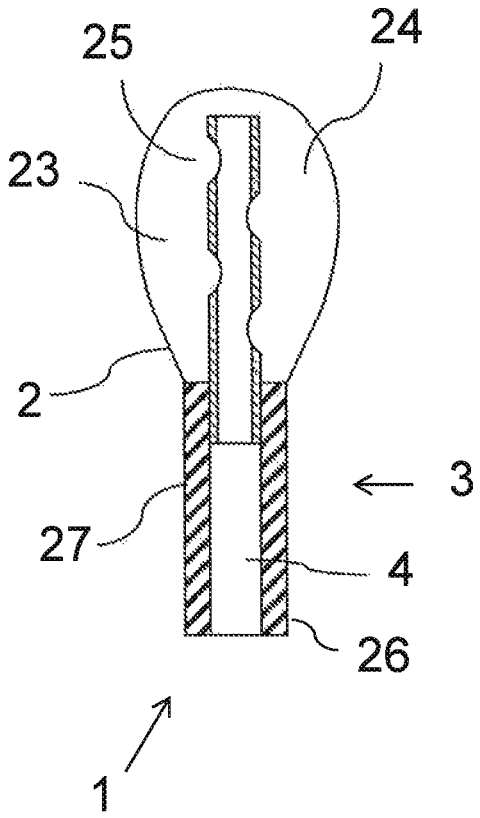

In FIG. 1B, an example of a device which may be used for stimulating e.g. hypothalamic activity by imparting vibrations to the posterior part of the nasal cavity is shown. The device 1 comprises an expandable stimulation member 2 depicted in an at least partly expanded state. The interior 23 of the stimulation member 2 is fluidly connected with an expansion member 3 arranged to expand the stimulation member. The expansion member 3 comprises a tubular structure 24, which may be arranged at least partly within the stimulation member. The tubular structure 24 is provided with a plurality of openings 25 arranged for fluid communication with the interior 23 of the stimulation member 2. The expansion member 3 moreover comprises an elongated structure 26 arranged in fluid communication with the interior 23 of the stimulation member via the tubular structure 24. The elongated structure may be arranged essentially outside the stimulation member 2, or partly inside the stimulation member 2. The elongated structure may enclose a part of the tubular structure 24. Each end portion of the tubular structure 24 may be provided with an opening for fluid communication with the interior 23 of the stimulation member and the elongated structure 26. Fluid communication may be accomplished through channel 4. The tubular structure 24 may extend within essentially the entire length of the stimulation member 2. In one embodiment, the tubular structure leaves a distance from an end of the tubular structure to an inner wall of the stimulation member of 5 mm. The circumferential surface of the end portion of the tubular structure 24 is however distanced from the inner walls of the stimulation member.

An end portion 27 of the elongated structure arranged adjacent to the stimulation member, or arranged within the stimulation member, may function as a retaining portion when the device is inserted into the nasal cavity of a human subject. Such an end portion 27 of the elongated structure 26 may be inserted into the nostril of the human subject.

The tubular structure is sufficiently resilient to allow for insertion and positioning in, sometimes irregular, shape of the nasal cavity. This is particularly important for movements in the sagittal plane since the stimulation member must pass in a vertical bend through the vestibule. At the same time, the tubular structure must provide sufficient stiffness in order to avoid accidental bending during introduction into the posterior part of the nasal cavity. The tubular structure has a sufficient inner diameter in order to avoid flow resistance, which might cause damping out of vibrations before reaching the stimulation member. Furthermore, the tubular structure may have a wall thickness that in combination with the plurality of openings achieves a suitable stiffness. Other material and mechanical properties may also have an influence on the stiffness of the tubular structure.

An end portion of the tubular structure arranged within the stimulation member may be rounded or beveled to prevent the device from getting stuck when introduced into the nasal cavity and to minimize any discomfort for the patient.

The tubular structure comprising the plurality of openings may enable expansion of the stimulation member along its entire length. Since the walls of the nasal cavity varies between individuals and sometimes result in narrow passages, the plurality of openings allows fluid to enter and expand the stimulation member along its entire length. In the embodiment shown in FIG. 1B the openings have been placed alternating on the two sides of the tubular structure to ensure that the anisotropic stiffness is sufficient.

Figure 2A:
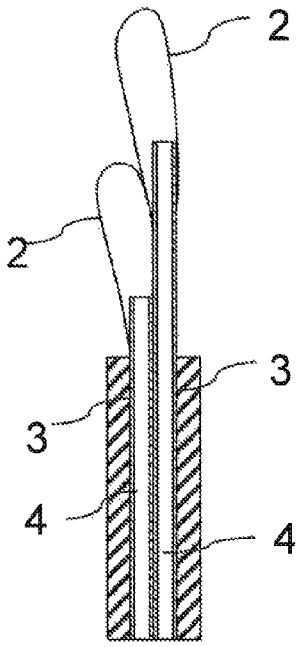

The system of the present invention may further have two or more vibration stimulation devices 1 or two or more stimulation members 2. An example of a device having dual vibration stimulation devices 1 is shown in FIG. 2A. Devices with more than one vibration stimulation device 1 or stimulation member 2 can be used for stimulating different parts of a tissue, e.g. to provide vibrations to a larger area of the tissue, or to different tissues, i.e. different parts of the ANS. The vibration stimulation devices 1 or stimulation members 2 may thus be situated in close proximity or at greater distance in the device. Two or more vibration stimulation devices 1 or stimulation members 2 may also or alternatively be used to provide different frequencies to different parts of the tissue. Furthermore, they can either be positioned in close proximity to each other or be brought to vibrate at different frequencies to create an amplitude modulation, or they can be placed at different parts of the body to provide simultaneous stimulation. The stimulation members 2 are, like the stimulation member 2 in the previous example, provided with respective expansion members 3 or with a shared expansion member 3 that provides fluid to the stimulation member 2. Each stimulation member 2 is also connected to a shared vibration member or to a respective vibration member as described above.

Figure 2B:
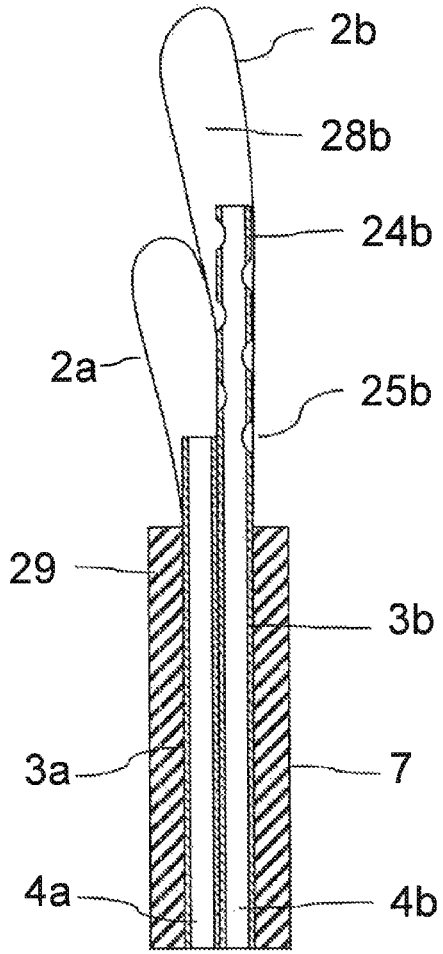

In FIG. 2B, yet another specific example of a device according to the present invention will be described. The device 1 of FIG. 2B resembles the embodiment depicted in FIG. 2A, in that it comprises two stimulating members 2*a* and 2*b*. Each stimulation member is connected to an expansion member 3*a* and 3*b* for expanding the stimulation members 2*a* and 2*b*. The expansion member 3*b* connected to the posterior stimulating member 2*b* however comprises a tubular structure 24*b*, which may be arranged at least partly within the stimulation member 2*b*. The tubular structure 24*b* is provided with a plurality of openings 25*b* arranged for fluid communication with the interior 28*b* of the stimulation member 2*b*. The tubular structure 24*b* may, together with the expansion member 3*a*, be enclosed in a common housing 7. In one embodiment, the tubular structure 24*b* leaves a distance from an end of the tubular structure to an inner wall of the stimulation member 2*b* of 5 mm. The end portion of the tubular structure 24*b* is distanced from the inner walls of the stimulation member 2*b*.

Figure 3:
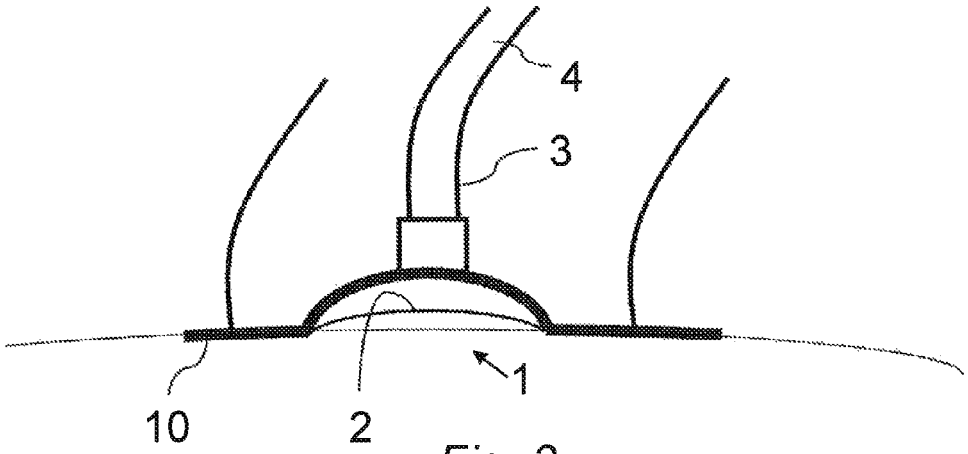

Still another example of a vibration stimulation device 1 is shown in FIG. 3. The shown vibration stimulation device is arranged for imparting vibrations onto tissues that are not necessarily located within body cavities, typically tissues that are more flat and more exposed than the tissues of a body cavity. Examples include areas of the skin on the torso or on the extremities, or surfaces of internal organs during surgery. For example, the vibration stimulation device may be arranged as part of a belt, a cuff, a vest, an adhesive patch or a similar anchoring member 10, to be attached to or around the torso, on the back or around an arm or a leg, see also FIG. 8-10. In the shown embodiment a stimulation member 2, in form of a pouch, bag, balloon or membrane, is attached to the anchoring member 10 and is arranged to abut against the tissue to be stimulated while also being able to vibrate and able to impart the vibrations onto the tissue. In such an embodiment the material of the stimulation member 2 may be different from the material of the anchoring member 10, the stimulation member 2 being made of a material that is suitable for imparting vibrations onto the tissue and the anchoring member 10 being made of a material that is suitable for the attachment to the body. The stimulation member 2 is connected to a vibration member that is arranged for bringing the stimulation member to vibrate. In one embodiment the stimulation member 2 forms a chamber for receiving fluid, e.g. by being a bag, a pouch or a balloon, or by being a membrane that, together with the anchoring member 10, forms a chamber. The stimulation member 2 may even be arranged as a chamber that is formed between the anchoring member 10 and the underlying tissue, i.e. not including a membrane, balloon or similar means. The fluid, e.g. air, within the chamber then imparts the vibrations onto the tissue directly. This requires that the anchoring member 10 forms a fluid tight seal with the tissue, such that no, or almost no, fluid escapes from the chamber. An expansion member 3 with a channel 4 is connected with the stimulation member 2 and is configured to supply fluid to the chamber. The vibration member is arranged so as to supply vibrations to the fluid contained within the chamber, similarly to the arrangement described above in connection with FIG. 1A-B.

In another embodiment the vibration member is the stimulation member 2. That is, the vibrations are directly imparted onto the tissue by the vibration member.

In one embodiment the vibration stimulation device 1 is integrated with the anchoring member 10. For instance, the vibration stimulation device 1 may be integrated with an inflatable cuff or belt, which is supplied with fluid in the form of liquid or gas.

In another embodiment the stimulation member 2 is made of the same material as the anchoring member 10 and is an integrated part of the anchoring member 10. For example, the stimulation member 2 may be arranged as a cuff or a belt made of a material that can convey vibrations and impart the vibrations onto the tissue, see e.g. FIG. 8-9. The cuff or belt may for example be inflatable and thus supplied with fluid in the form of liquid or gas. The vibration member may then be arranged to supply vibrations to the fluid within the cuff or belt, causing the material of the cuff or belt to vibrate and thus impart the vibrations onto the underlying tissue.

As has been described through the non-limiting examples above the stimulation member 2 may be in shape of a balloon, a bag, a pouch or a membrane. Other examples of a stimulation member 2 include bubbles and foam devices. The material of the stimulation member 2 is able to convey vibrations in the range of 10-100 Hz, or sub-intervals thereof (see below), and to impart those vibrations onto the tissue. The material may be flexible, providing the stimulation member 2 with elastic properties. The size and volume of the stimulation member 2 may consequently vary by an inner pressure. In alternative embodiments, the stimulation member 2 is made up of an inelastic but flexible material or has partly elastic properties.

The stimulation member 2 may be made of a material such that it does not chemically or biologically affect any body tissue with which it comes into contact. For instance, the stimulation member 2 may have no local effect on body tissue. Non-limiting examples of materials are plastic materials or rubber materials. In some instances, the stimulation member 2 is made of latex.

In another embodiment the stimulation member 2 is made of or coated with a material that has a chemical or biological activity on the body tissue with which it comes into contact.

In another embodiment the stimulation member 2 may comprise means for distributing a pharmaceutical or a therapeutic gas, such as $CO_2$. With such an embodiment combination treatments can be realized, further increasing the therapeutic applicability of the invention.

The stimulation member 2, especially when arranged for introduction into body cavities, may furthermore comprise an outer surface that minimizes friction between the stimulation member 2 and the surrounding tissue during introduction into the body cavity. The stimulation member 2 may e.g. be constructed from a material providing a smooth outer surface or be coated with a lubricant, such as e.g. a paraffin solution.

The shape and dimensions of the stimulation member 2 depend on the part of the ANS and the associated tissue to be stimulated. For nasal stimulation of an adult person the length of the stimulation member is approximately 3-100 mm, such as 40-60 mm, and the widths is approximately 1-40 mm, such as 10-20 mm. When manufactured for use with a newborn or an animal the dimensions of the stimulation member 2 have to be adjusted accordingly. Furthermore, the dimensions of a stimulation member 2 for use at a location of the body other than the nose may vary even more. In some embodiments the system comprises a plurality of vibration stimulation devices 1 or vibration stimulation members 2, such vibration stimulation devices 1 or vibration stimulation members 2 may also have different geometrical shapes and dimensions. The individual stimulation members 2 may differ in length and width and may exhibit different laterally curved and bent forms to facilitate proper stimulation of respective ganglia or parts of the ANS. A kit comprising two, three, four, five or more stimulation members 2 of different shape and dimension may also be provided.

In embodiments where the vibration stimulation device 1 comprises a vibration member arranged to bring the stimulation member 2 to vibrate, the vibration member may for example comprise a vibration generator controlled by an applied electrical voltage supplied from a control unit. In such examples, the vibration member may be arranged within the stimulation member 2.

In another example, the vibration member is externally arranged. Such an external vibration source, for example a transducer, may be arranged so as to supply vibrations to a fluid contained within the stimulation member 2.

Vibrations may furthermore be imparted to the tissue via the fluid comprised within the stimulation member 2. Thus, the vibration member may provide vibrations to the fluid, which functions as a medium for transferring vibrations via the expansion member 3 to the stimulation member 2.

The vibratory stimulation on the tissue may be conducted at a frequency of between 10-100 Hz. Other frequencies are also conceivable. The chosen frequency should be adapted to the chosen part of the ANS, e.g. the chosen ganglion, to be treated. Furthermore, the frequency may be changed over time during the treatment. It may also be changed in response to the effect that the treatment has on the ANS, as determined by use of sensors and monitoring means or members. This will be further described below.

The stimulation member 2 according to the present invention can also be brought to vibrate with various wave patterns depending on field of application. The stimulation member 2 can for instance be brought to vibrate in such a way that the vibrations can be described with a sinus wave or as a square wave.

The amplitude of the vibrations applied to the tissue is in the range of between approximately 0.05 mm and approximately 20 mm, such as between approximately 0.3 mm and approximately 5 mm, but other amplitudes are also conceivable. It should be understood that the amplitude required for a certain level of stimulation of the autonomous nervous system is governed by the nature of the ganglion to be affected, the tissue surrounding it and the sensitivity of the patient in question.

The stimulation member is arranged to abut the tissue at a pressure that is dependent on the tissue and on the particular ganglion or part of the ANS to be stimulated. For stimulation of the hypothalamus, via the tissue of the posterior part of the nasal cavity, the stimulation member 2 is for instance arranged to abut the tissue at a pressure of approximately 70-120 mbar, such as 75-100 mbar. For nasal stimulation of the sphenopalatine ganglion the stimulation member 2 is for instance arranged to abut the tissue at a pressure of approximately 20-40 mbar. For stimulation of the intestine a pressure of 20-50 mbar may be used.

Anchoring Member

The system of the present invention may comprise an anchoring member. The anchoring member keeps the vibration stimulation device 1 in place and prevents the device from unintentional movement during the stimulation. As the skilled person realizes the anchoring member can be arranged in numerous different ways and by different materials. They should be adapted to the part of the body that is to be treated. The anchoring member may for example be provided in the form of a headband, a facial mask, a pair of glasses, a helmet, a belt, a cuff, a vest or an adhesive patch. Headbands, facial masks, glasses and helmets are especially suited for anchoring vibration stimulation devices for stimulation in the nasal cavity and parts of the head and neck. Belts are suitable for anchoring vibration stimulation devices for stimulation of the torso, and cuffs are suitable for anchoring vibration stimulation devices for stimulation of the extremities, i.e. an arm or a leg.

The anchoring member 10 may comprise a detection member 18 that enables collection of data reflecting a measure of activity in the ANS, or may comprise at least part of a sensor or a monitoring member 75 as described below. For this disclosure a detection member 18 is to be understood as a member that in itself is passive, e.g. an EEG, EMG or ECG electrode, whereas a sensor or a monitoring member 75 is configured to execute data collection and/or to receive collected data.

Examples of different anchoring members are shown in FIG. 4-11.

Figure 4A:
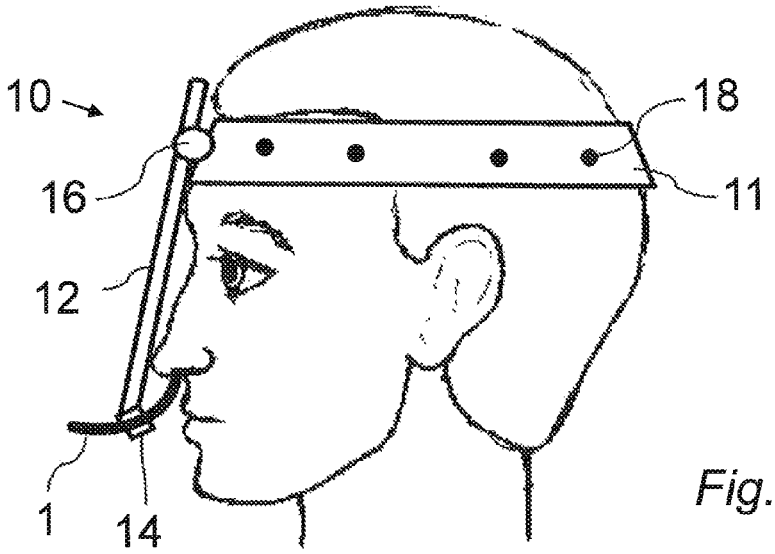
FIGS. 4A-D, 6A-D, 7A-B, 8A-D, 9A-B, and 10-12 are schematic representations each depicting an example of an anchoring member according to the present invention.
Figure 4B:
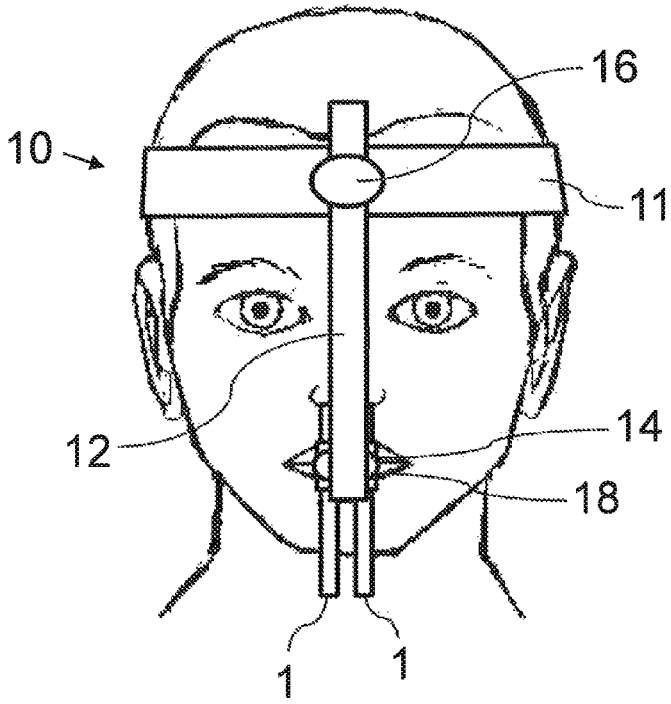
Figure 4C:
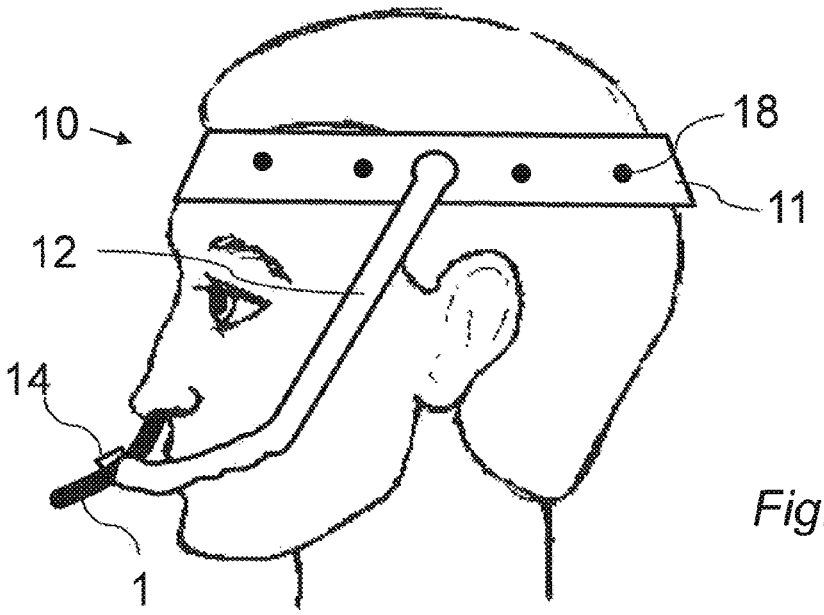
Figure 4D:
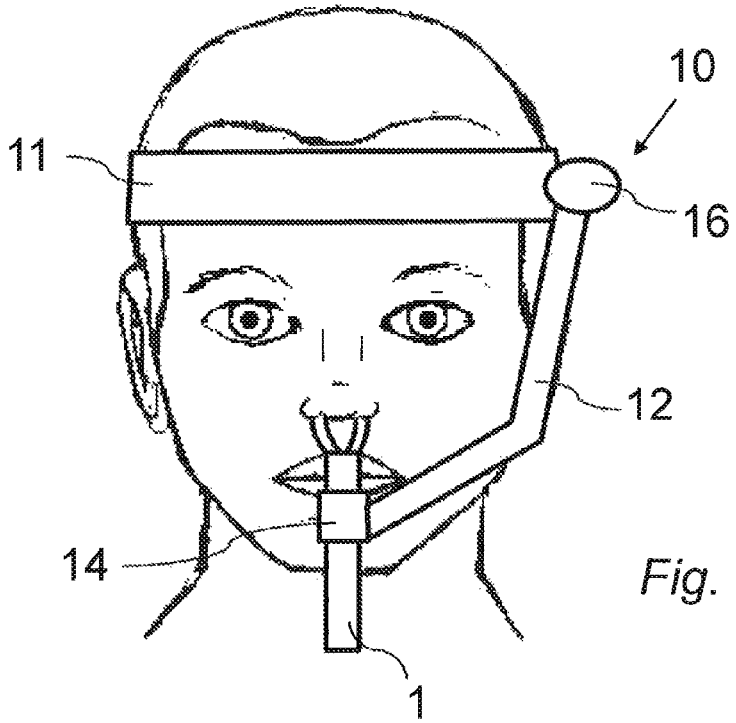

FIG. 4A shows a side view of an anchoring member 10 comprising a headband 11 and a support arm 12, for anchoring a vibration stimulation device 1 used for vibration stimulation in the nasal cavity. Disorders that can be treated via the nasal cavity include migraine, cluster headache, ALS and Ménière's disease. The headband is preferably elastic to fit closely to the human subject's head. In another example, the headband is at least partly non-elastic and the headband can be adjusted around the human subject's head using an adjustment member. The support arm 12 may rest on the bridge of the nose. A desired feature for any anchoring member used for nasal stimulation is to provide an easy way to move the vibration stimulation device 1 from one nostril to another. The support arm is thus preferably also configured such that it is movable in the lateral direction, along the length of the headband 11. As an alternative the support arm is fixed relative to the headband and provided with an adjustable end portion to which the stimulation device is attached. The angle of the support arm 12, in relation to the headband 11 and the face, may be adjusted via angle adjustment member 16, e.g. in the form of a hinge. The support arm 12 comprises attachment member 14 for attachment of the vibration stimulation device 1, optionally for releasable attachment. The attachment member 14 may also be configured with means, e.g. a connection joint 19, enabling adjustment of the angle between the support arm 12 and the vibration stimulation device 1. FIG. 4B shows a front view of a similar anchoring member 10, adapted for dual stimulation with two vibration stimulation devices 1, one for each nostril. The attachment member 14 is thus configured to accommodate two vibration stimulation devices 1. FIG. 4C shows still another variant of an anchoring member 10 with a headband 11. In this variant the support arm 12 is attached to the side of the headband 11, which may be more comfortable for the patient and also has the advantage that it facilitates accommodation of two vibration stimulation devices 1 by having one support arm on each side of the head. It may also be used with only one vibration stimulation device 1. FIG. 4D shows a front view of a headband 11 with the support arm 12 attached on the side and with a vibration stimulation device 1 having dual stimulation members 2.

The headband may also comprise one or more detection members 18, e.g. in the form of electrodes for enabling EEG measurements or in the form of a photoplethysmographic sensor for attachment to the earlobe.

Figure 5:
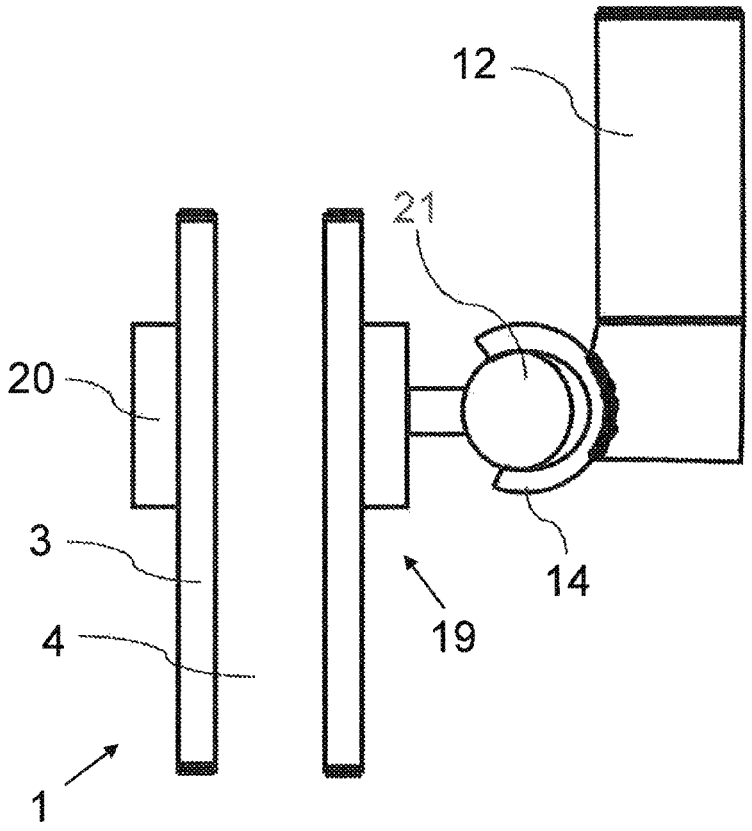
FIG. 5 is a schematic representation depicting an example of a connection member that may be used with the present invention.

FIG. 5 shows a schematic example of a connection joint 19 that may be used to connect the support arm 12 with the vibration stimulation device 1. The connection joint 19 may be a freestanding unit that can be releasably attached to both the support arm 12 and to the vibration stimulation device 1. Alternatively the connection joint 19 may be permanently attached to the vibration stimulation device 1, e.g. via the expansion member 3. The connection joint 19 comprises a first connection unit 20 and a second connection unit 21. The first connection unit 20 is arranged to connect to the vibration stimulation device 1, e.g. to its expansion member 3. It may for instance have a shape that matches the shape of the expansion member 3, such that the first connection unit 20 and the expansion unit 3 may be attached through snap fit. The second connection unit 21 is arranged to connect to the support arm 12. In the shown example the support arm 12 is provided with an attachment member 14 in the form of a socket, while the second connection unit 21 of the connection joint is shaped as a corresponding ball. Thus the attachment member 14 and the second connection unit 21 may form a ball and socket joint. As the skilled person realizes, the connection joint 19 may instead be provided with a socket and the support arm 12 with a ball. Other releasable fastening member between the support arm 12 and the connection joint are also conceivable. Preferably the fastening member enables rotation and/or adjustment of the angle between the support arm 12 and the connection joint 19.

An advantage with the connection joint 19 is that it facilitates the insertion of the stimulation member 2 into the nasal cavity. The connection joint 19 may be attached to the vibration stimulation device 1 before insertion of the stimulation member 2 into the nasal cavity. Only after the stimulation member 2 is in place is the connection joint 19 attached to the support arm 12. In this way one may avoid interference of the support arm 12 during insertion of the stimulation member 2 into the nasal cavity.

Figure 6A:
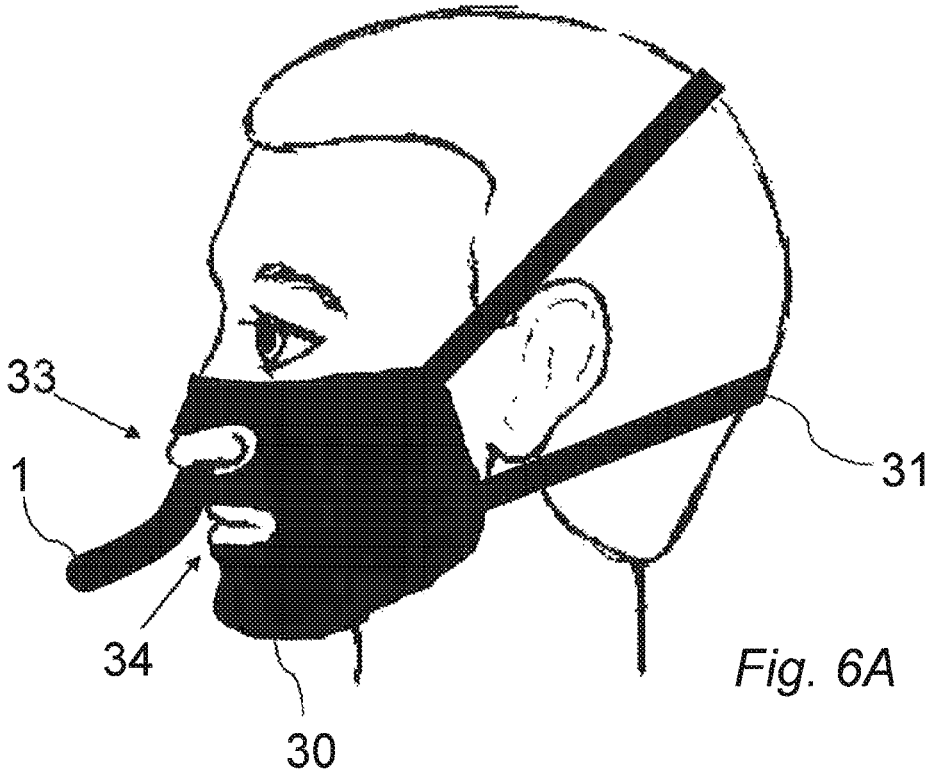
Figure 6B:
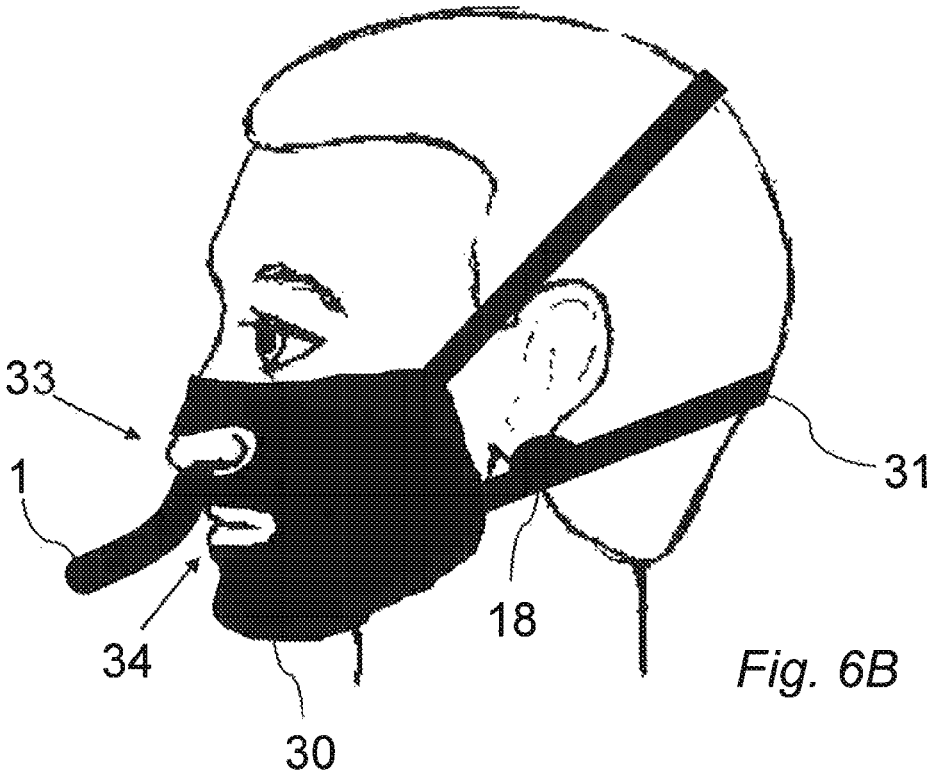
Figure 6C:
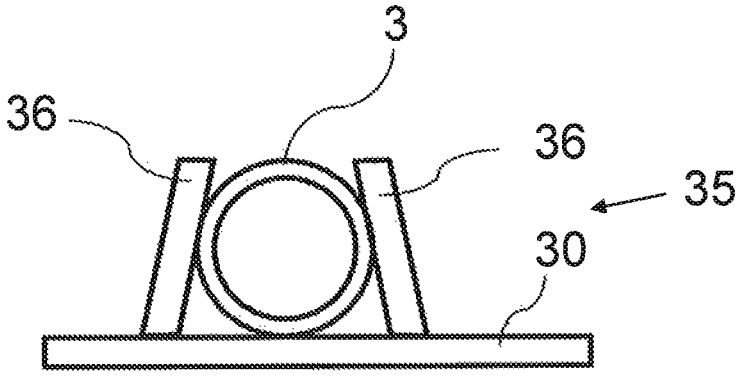
Figure 6D:
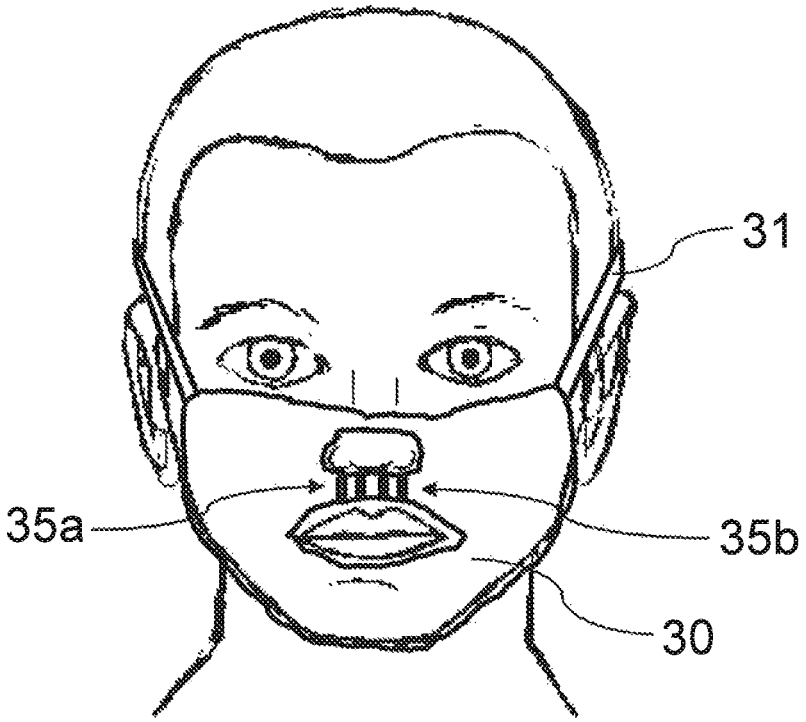

FIG. 6A-D show examples of anchoring members 10 comprising a facial mask 30 with head straps 31, also for use with a vibration stimulation device 1 adapted for vibration stimulation in the nasal cavity. The facial mask 30 is preferably elastic to allow adaptation to variations in head size of human subjects. In one example, the facial mask 30 has holes for the nose 33 and the mouth 34. In another example, the mask 30 is preferably permeable to air to allow breathing during stimulation. The mask 30 may be fixed onto the face using two straps 31, preferably elastic straps. Furthermore, the mask may comprise at least one locking member 35, for holding the stimulation members in fixed positions during stimulation. FIG. 6C shows a schematic representation of one embodiment of such a locking member 35. Locking units 36 that are attached to the facial mask 30 hold the expansion member of a vibration stimulation unit in place by a snap fit mechanism. FIG. 6D shows an example of a facial mask comprising two locking members 35*a*, 35*b* for attachment of two vibration stimulation devices 1 side by side, e.g. for use in each of the nostrils of the subject or one stimulation member used in the left and right nostril sequentially.

The mask may also comprise one or more detection members 18, e.g. in the form of a photoplethysmographic sensor for attachment to the earlobe.

Figure 7A:
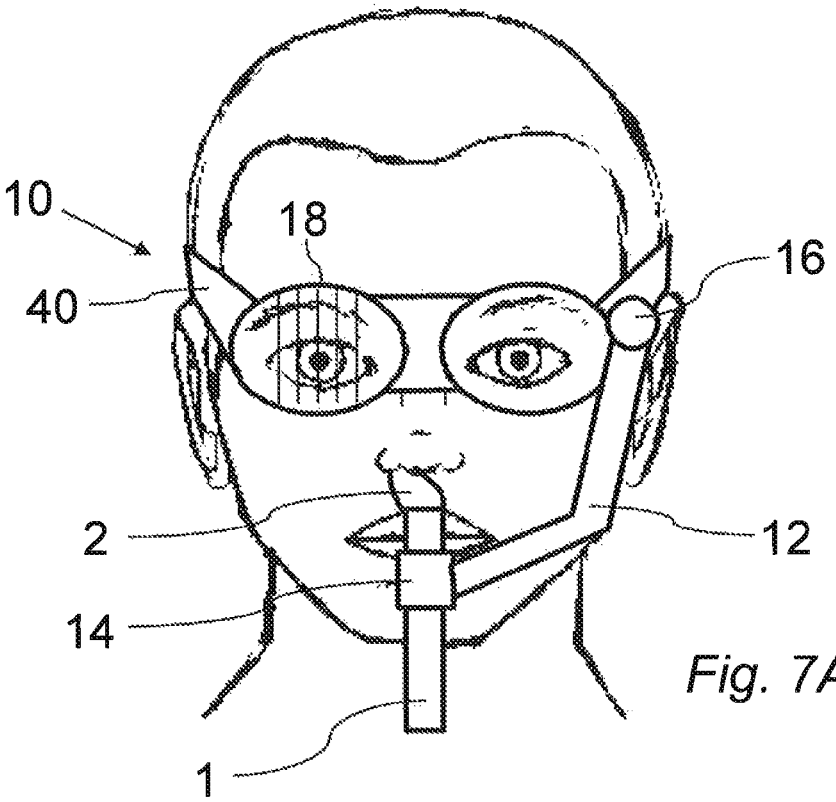
Figure 7B:
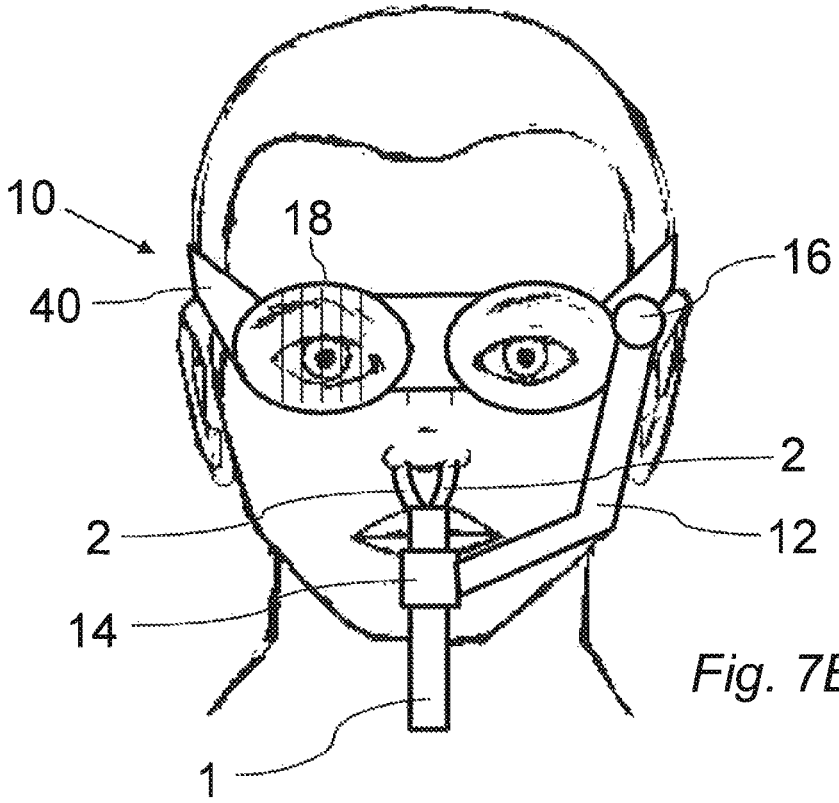

The anchoring member of the present invention may further be in the form of a pair of glasses 40, as shown in FIG. 7. FIG. 7A shows a pair of glasses anchoring a vibration stimulation device 1 with a single stimulation member 2. FIG. 7B shows anchoring of a vibration stimulation device 1 with dual stimulation members 2. The glasses 40 are provided with a support arm 12 and, optionally, angle adjustment member 16, attachment member 14 and/or a connection joint 19, according to the same principles as for the headband. The pair of glasses 40 can be arranged with dark glasses, or at least only partly transmit light, for avoiding light coming into the eyes of the subject during stimulation. This is for example advantageous when treating subjects that are light sensitive, e.g. photophobia experienced during headache attacks.

The pair of glasses 40 may also comprise one or more detection members 18, e.g. in the form of a device for manual or automatic measurement of the pupil size.

Figure 8A:
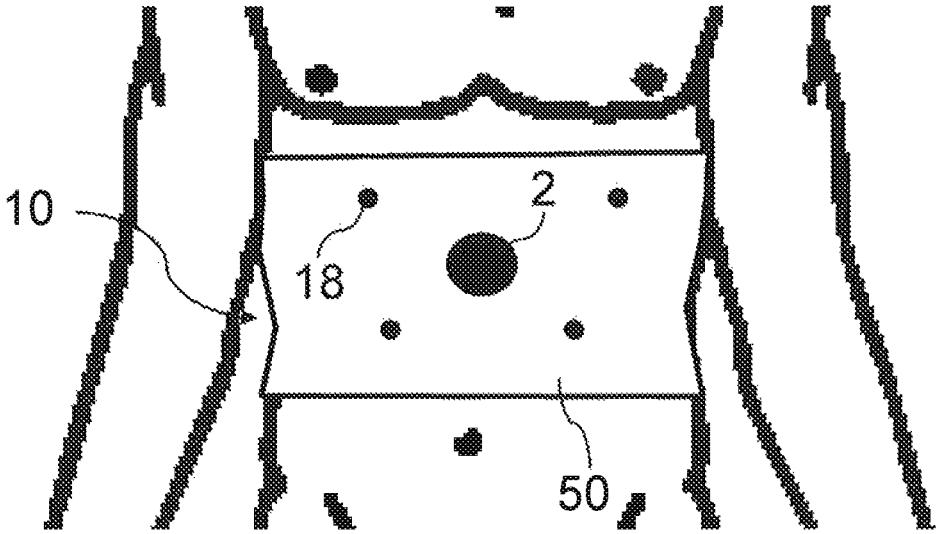

FIG. 8A shows an example of an anchoring member 10 in the form of a belt 50. The shown belt comprises a vibration stimulation device 1, e.g. of the type shown in FIG. 3. In other embodiments the belt 50 may also comprise two or more vibration stimulation devices 1 or stimulation members 2. The belt 50 may for instance be used for treatment at the solar plexus, also known as coeliac plexus or celiac plexus. Disorders that can be treated via the solar plexus include irritable bowel syndrome (IBS) and Crohn's disease. Preferably the belt 50 is inflatable, such that the pressure between the belt 50 and the underlying tissue can be adjusted. In this way the positioning of the belt may, when the belt is not filled, easily be adjusted such that the stimulation member 2 can be placed in the desired position for the stimulation. When the belt 50 is in the desired position the belt is inflated, thereby firmly anchoring the stimulation member 2 in the correct position as the pressure between the belt and the body increases. Another advantage of an inflatable belt is that the pressure between the stimulation member 2 and the underlying tissue can be adjusted and optimized for the specific treatment to be conducted.

As is shown in FIG. 8A the stimulation member 2 may be arranged as a pouch, bag, balloon or membrane of another material than the belt in itself, i.e. the stimulation member is separate from, although integrated with, the belt. In another embodiment the belt 50 and the stimulation member 2 are fully integrated, i.e. the belt 50 functions as a stimulation member 2. In such embodiment the belt 50 is made of a material that is able to impart the vibrations onto the underlying tissue to be stimulated. The vibration stimulation will in such case cover a larger and less well defined area of the patient's body. In still another embodiment only part of the belt is made of a material that can impart vibrations and function as a stimulation member.

Vibrations can be imparted to the stimulation member 2 by an integrated or external vibration member e.g. via oscillating fluid (liquid or gas), or by other means e.g. a piezoelectric transducer, a loud speaker or a voice coil motor.

The belt 50 may also comprise one or more detection members 18, e.g. in the form of electrodes for ECG or EMG measurements or a sensor for measuring skin conductance or pressure.

Figure 8B:
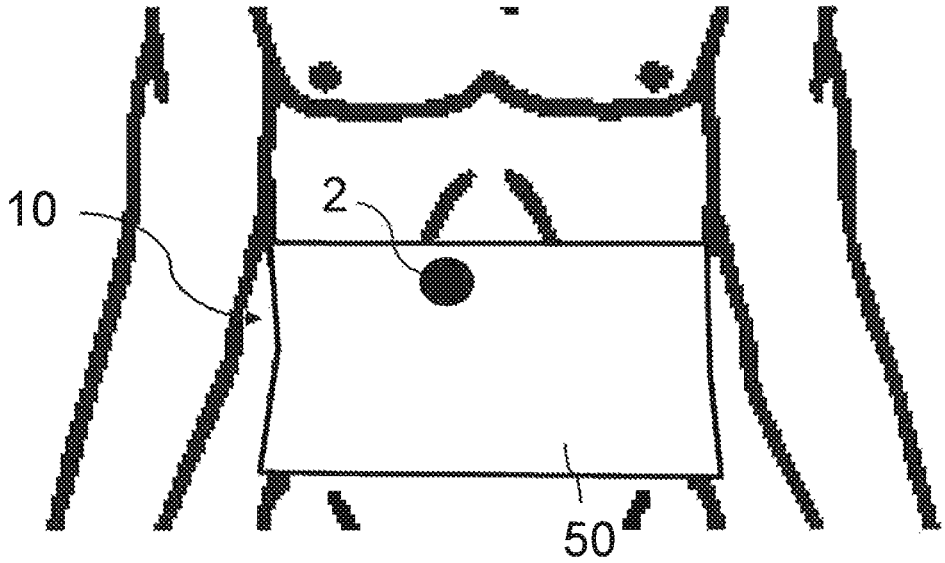
Figure 8C:
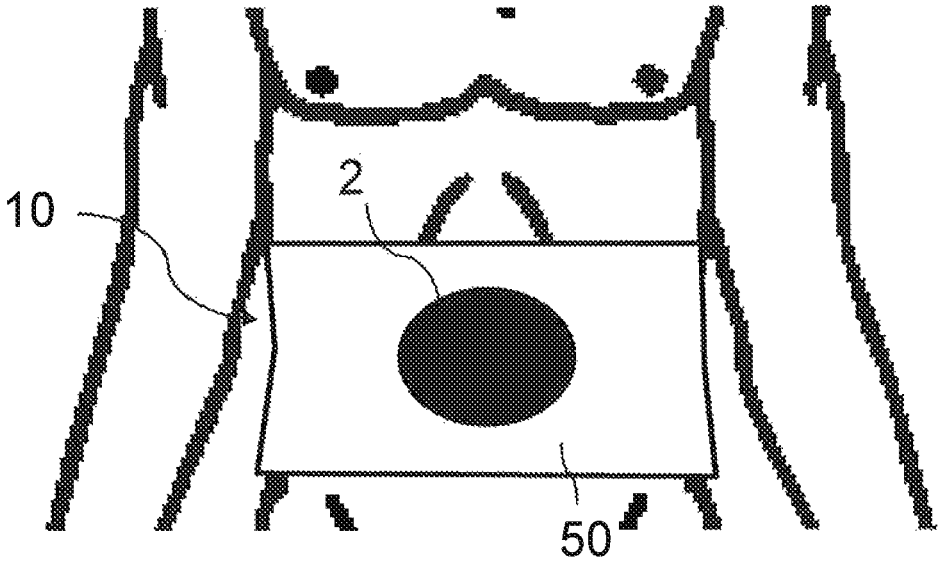

FIG. 8B shows an example of the anchoring member 10 of FIG. 8A, wherein the stimulation member 2 may have a diameter of 75 mm. FIG. 8C depicts another example of the anchoring member 10, having a larger stimulation member 50 of a diameter of 200 mm.

Figure 8D:
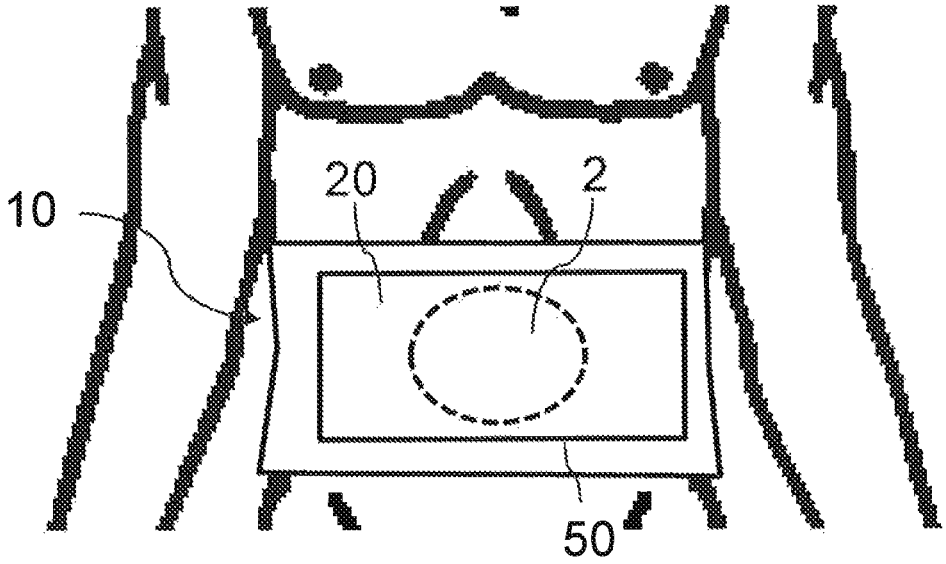

To enable the vibrations to be transmitted to the body of the patient, a counterweight 20 of e.g. 2 kg may be applied on top of the stimulation member 2, such as depicted in FIG. 8D. Taking air in or out of the stimulation member 2 (indicated by a dotted line) may affect the contact area between the patient and the stimulation member 2, and thus the contact pressure may be modified.

Figure 9A:
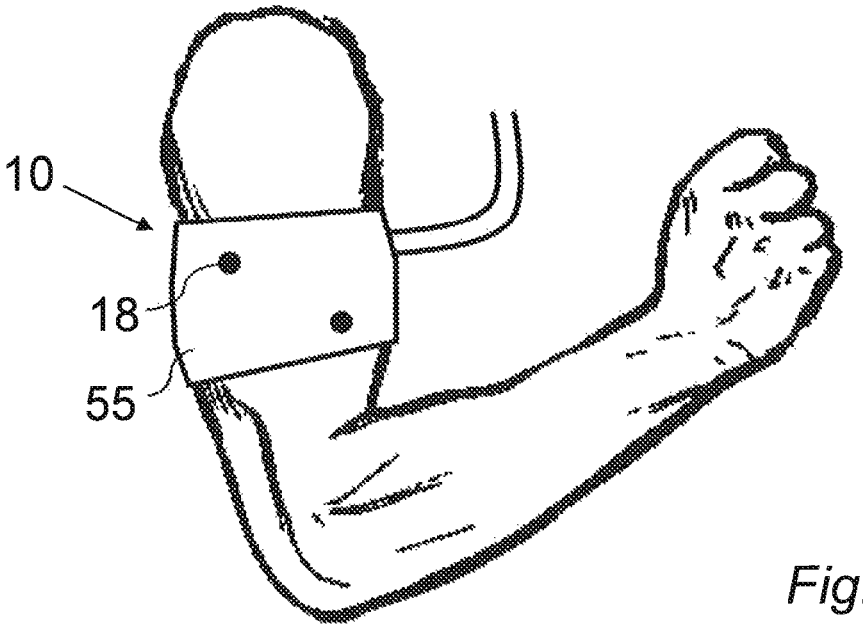

FIG. 9A shows an example of an anchoring member 10 in the form of a cuff 55. A cuff 55 may for instance be used for treatment of an arm or a leg. The cuff may be arranged according to the same principles as described above for a belt. It may for instance be inflatable and may comprise at least one vibration stimulation device 1 or stimulation member 2, e.g. of the type shown in FIG. 3, or may impart the vibrations via the cuff itself. The cuff may also be arranged as a blood pressure cuff, such that it has the dual functions of being able to provide vibrations as well as monitor the blood pressure of the patient. The cuff 55 may also comprise one or more other detection members 18, e.g. in the form of electrodes for EMG measurements or a sensor for measuring skin conductance or pressure. Disorders that can be treated using vibrations imparted by an arm or leg cuff include arteriosclerosis and rheumatoid arthritis.

Figure 9B:
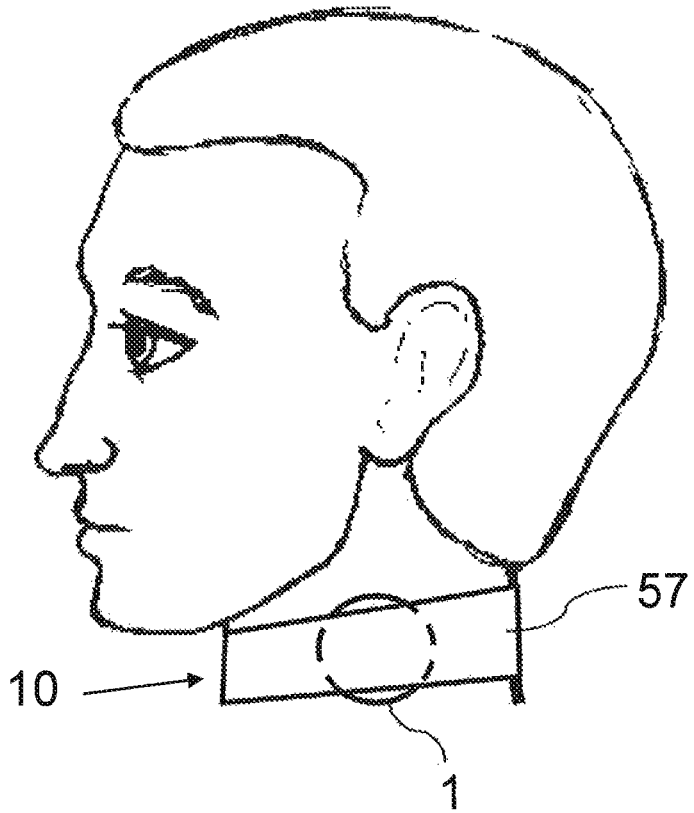

FIG. 9B shows an example of an anchoring member 10 in the form of a collar 57. The collar is arranged for keeping the vibration stimulation device 1 in place during treatment administered to the neck, preferably between the trapezius muscle and the sternocleidomastoid muscle (occipital triangle). The stimulation device 1 is shown as circular (contours hidden by the collar are shown as dashed lines). The collar 57 may be stiff to ensure that the vibrations affect the tissue. To increase patient comfort, some bolstering may be provided around the collar 57 edges. Disorders that can be treated using vibrations imparted to the neck by a vibration stimulation device 1 kept in place by a collar 57 may include for example ALS.

Figure 10:
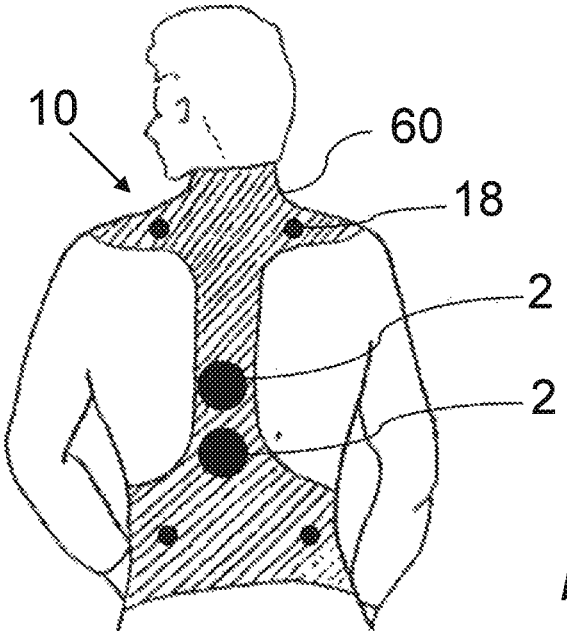

FIG. 10 shows an example of an anchoring member 10 in the form of a vest 60. In the shown example the vest comprises two vibration stimulation devices 1 or stimulation members 2. However, use of one, two or more vibration stimulation devices 1 or stimulation members 2 is conceivable. The at least one vibration stimulation device 2 is preferably of the sort described in connection with FIG. 3. The vest 60 is configured such that the stimulation member 2 can be arranged to abut the tissue of the back with a pressure that is suitable for the vibration stimulation. Preferably the vest is elastic and has a stiffness that is suitable for achieving the suitable pressure. The vest 60 may for instance be used for stimulation of the paravertebral ganglia. The vest 60 may also comprise a detection member 18, e.g. in the form of an electrode for measuring ECG or EMG activity or a sensor for measuring skin conductance or pressure.

Figure 11:
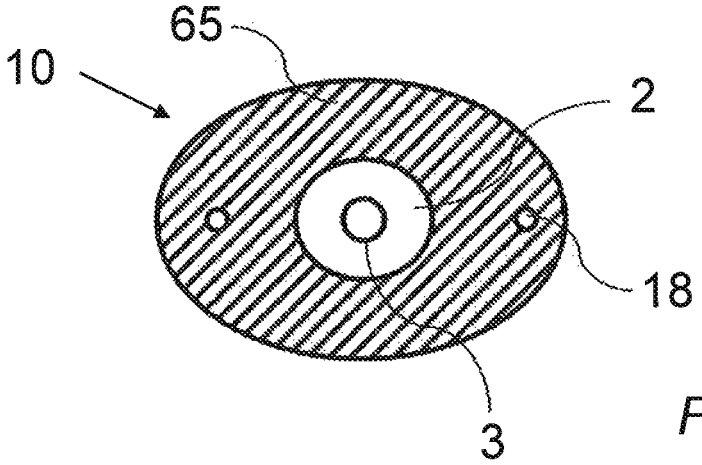

FIG. 11 shows an example of an anchoring member in the form of an adhesive patch 65. The patch 65 comprises at least one vibration stimulation device 1 or stimulation member 2 and has got an adhesive surface to be attached to the part of the body selected as a treatment site. The vibration stimulation device 1 is preferably of the sort described in connection with FIG. 3. The adhesive patch may also comprise a detection member 18, e.g. in the form of an electrode for measuring EEG, EMG or ECG activity or a sensor for measuring skin conductance or pressure.

Figure 12:
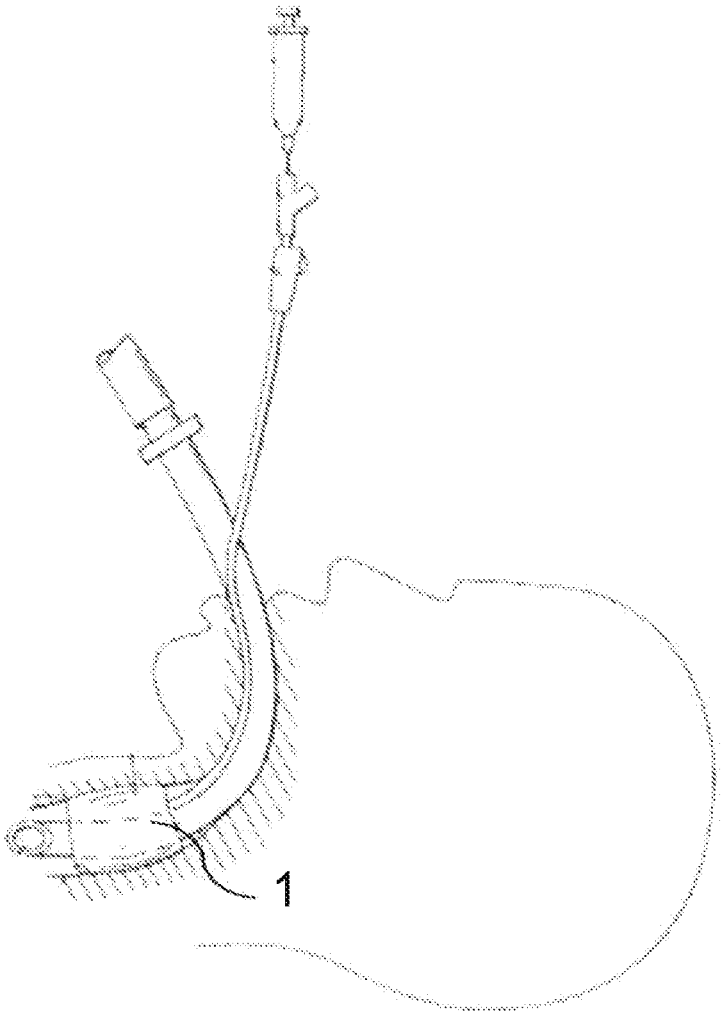

FIG. 12 shows an anchoring member 10 in the form of a cuff for an endotracheal tube 70. These are used e.g. for ventilation during surgery. It is known that when performing certain types of surgery in the larynx the tube must be removed within a certain time or else the larynx will be damaged (Hermes C. Grillo, *Surgery of the trachea and bronchi* (2004), pages 302-307, ISBN 1550090585, PMPH-USA). The explanation for this is not entirely clear but it is assumed that if the nerves in the larynx are properly stimulated the damage can be avoided. Stimulation in the form of vibrations can be administered via the cuff 70, an inflatable member meant to keep the tube in place. Care must be taken so that vibrations do not cause the cuff to move in a longitudinal direction. One way is to provide the cuff with a structured surface that gives high friction in this direction.

Another embodiment is to impart vibrations to the inside of esophagus. Nasogastric intubation is a well known technique for feeding and administering drugs. In this case such a tube would be equipped with a vibration stimulation member. The purpose of treating this part of the body can for example be to stimulate the vagus nerve which is partly situated close to the esophagus.

Monitoring Member

The system of the present invention comprises a monitoring member 75 for receiving input data reflecting a measure of activity in the ANS of the subject. Such data can be used as a measure of a bodily response in order to determine whether the vibration stimulation should continue, be adjusted or can be terminated. The monitoring member 75 is either a sensor that collects a direct measure of a parameter related to ANS activity, or alternatively is a data receiving member that receives data that has previously been collected by a sensor or a detection member 18. In the case where the monitoring member 75 is a data receiving member, the received data is in one embodiment raw data that is directly received from a detection member 18. In another embodiment the received data is data that has been processed after having been collected by the detection member 18 and before being input to the monitoring member 75.

The input data is a measure of at least one parameter that is related to activity in the ANS. The parameter may be related to any or both of sympathetic and parasympathetic activity in the ANS. The monitoring member 75 may receive input data that reflects indirect or direct measures of the activity in the ANS.

The monitoring member 75 may be integrated with the vibration stimulation device 1 of the present invention or may be provided as a separate device that can be coupled to the vibration stimulation device 1.

Monitoring members 75 that may be used with the present invention include pressure sensors that measure the pressure between the vibration stimulation device and the underlying tissue, means for measuring the pupil size of the subject, means for measuring the blood pressure of the subject, means for measuring the body temperature of the subject, electroencephalographic (EEG) recorders, electromyographic (EMG) recorders, e.g. electromyographs, electrocardiographic (ECG) recorders, i.e. electrocardiographs, and photoplethysmographic sensors.

The monitoring member 75 may also or alternatively include means for receiving input data reflecting a measure of the pressure between said tissue and said vibration stimulation device, a measure of the electrical conductivity of said tissue, a measure of the compliance in said tissue, a measure of the pupil size of the subject, an electroencephalographic (EEG) signal derived from the subject, an electromyographic (EMG) signal derived from the subject, an electrocardiographic (ECG) signal derived from the subject, a photoplethysmographic signal, a measure of the blood pressure of the subject or a measure of the body temperature of said subject.

In one embodiment the measure of ANS activity is obtained by functional neuroimaging. This means that the input data received by the monitoring member thus reflects ANS activity as measured by functional neuroimaging. More specifically, the input data reflecting a measure of ANS activity may be selected from the group consisting of oxygen consumption as measured by functional Magnetic Resonance Imaging (fMRI); metabolic activity as measured by Positron Emission Tomography (PET); magnetic signals as measured by magnetoencephalo-graphy (MEG), and electrical signals as measured with electroencephalo-graphy (EEG). Such measures and monitoring methods are examples of direct measures of ANS activity. It is anticipated that new and improved methods and devices will be developed within the field of functional neuroimaging and that these will be possible to use in aspects of the present invention.

The monitoring member 75 can be at least partly integrated with the stimulation member 2. In embodiments of the present invention comprising an anchoring member 10 the monitoring member 75 may also or alternatively be integrated with the anchoring member 10. Monitoring members 75 that are suitable for at least partial integration with the stimulation member 2 include pressure sensors, sensors for use in determining the compliance of the tissue and sensors for use in determining the electrical conductivity and/or the electrical impedance of the tissue. Monitoring members 75 that are suitable for at least partial integration with the anchoring member include means for measuring the pupil size of the subject, means for measuring the blood pressure of the subject, means for measuring the body temperature of the subject, sensors for use in determining the tissue conductivity, electroencephalographic (EEG) recorders, electromyographic (EMG) recorders, electrocardiographic (ECG) recorders and photoplethysmographic sensors. For EEG, EMG and ECG recorders the electrode part for such recorders is suitably integrated with the anchoring member 10.

The anchoring member 10 may for instance partly comprise EEG, EMG or ECG recorders, i.e. electrode part of such recorders. FIGS. 4A and 4C show anchoring members 10 comprising headbands 11 with integrated EEG electrodes. FIG. 8 shows a belt with integrated EMG or ECG electrodes, for measuring motor neuron activity and heart rhythm or heart rate variability respectively. FIG. 9 shows an arm cuff with integrated EMG electrodes. The anchoring member 10 may in another embodiment comprise a photoplethysmographic sensor for measuring the blood flow, blood volume pulse and/or oxygen level in the blood. An example of an anchoring member with a photoplethysmographic sensor is shown in FIG. 6B. One of the straps 31 of the facial mask 30 is provided with a photoplethysmographic sensor for use with the ear.

The pupil size of the subject can be measured using a pair of glasses, e.g. a pair of glasses 40 that are also used as anchoring member 10, as shown in FIG. 7A-B. For example, a scale can be inserted on the surface of the pair of glasses to simplify measuring of the pupil size prior to and/or during stimulation. To increase the resolution the glass can comprise a lens of suitable focal length. Alternatively an automatic pupil response monitor or sensor, such as a pupilometer for measuring pupil size, can be integrated with the glasses. Such pupillometry is for instance disclosed in US 2008/0198330. The size of the pupil can be used as a measure of a bodily response such as the level of stress and attentiveness.

The system of the present invention may further comprise a signal processing member and/or a data analysis member for extracting and analyzing relevant information from the input data collected by the monitoring member 75. The ANS activity can be analyzed and evaluated with regard to an absolute value of the measured parameters. Alternatively the ANS activity can be evaluated from a rate of change or a frequency spectrum of the measured parameters.

System for Vibration Stimulation Treatment

The purpose of monitoring the effect on the activity of the ANS is to ensure that the treatment is effective and gives the desired result. The monitoring member 75 provides a way to get information on the effects of the treatment on the activity of the ANS and to use that information to adjust the treatment if needed. Depending on the purpose of the treatment, e.g. to cure a disease, alleviate symptoms or just calm or arouse the subject, the goal of the treatment is to either increase or decrease the activity of the ANS and the particular ganglion involved. In some cases both increased and decreased activity may be desired. The treatment may be adjusted by changing a vibration stimulation parameter, e.g. vibration frequency, vibration amplitude, vibration duration and/or the pressure between the stimulation member 2 and the stimulated tissue. The adjustment may be carried out manually or automatically.

Figure 13:
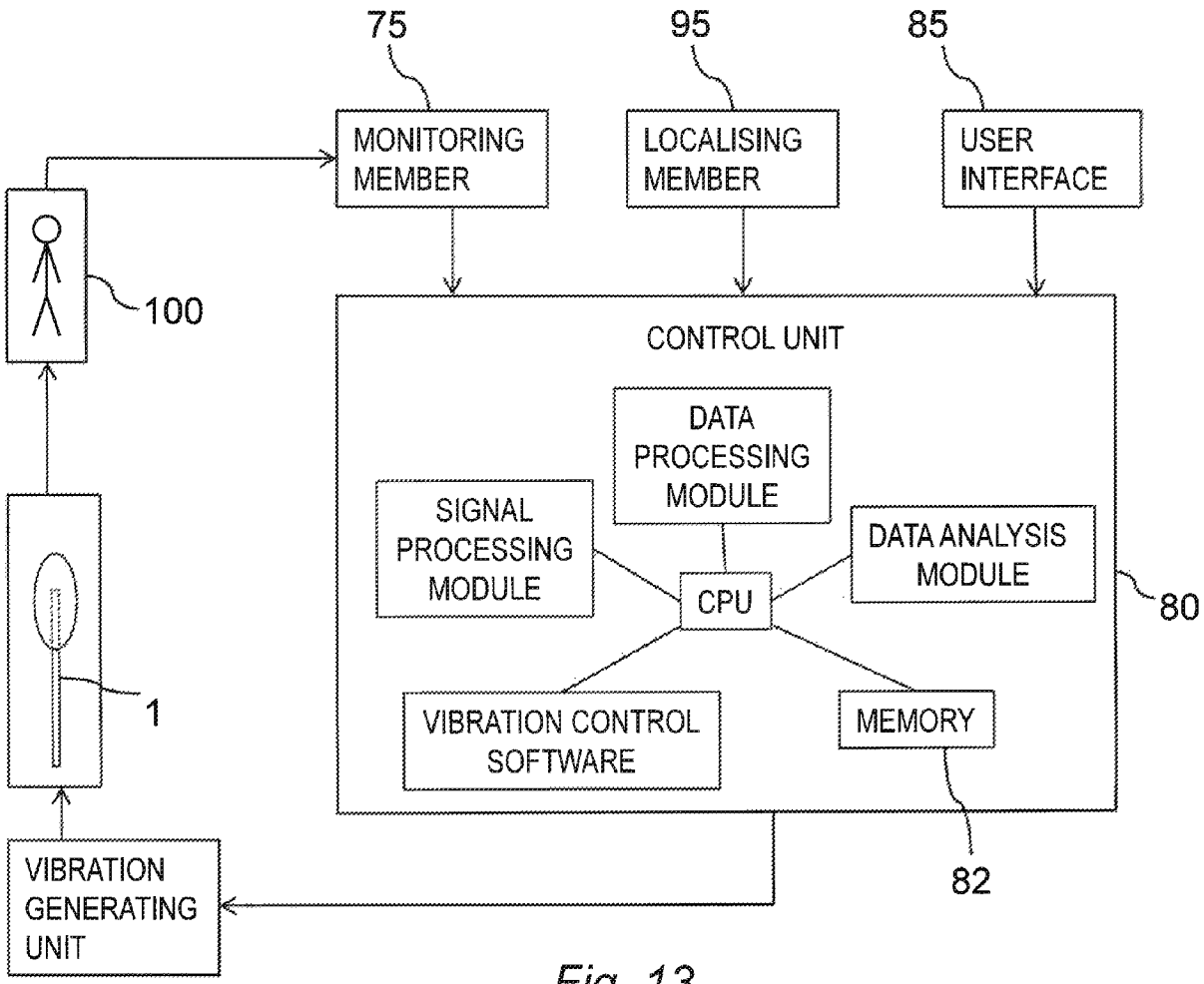
FIG. 13 is a block diagram generally depicting an example of a system according to the system aspect of the present invention.

A system according to one aspect of the invention is schematically depicted in FIG. 13. The system comprises a vibration stimulation device 1, a monitoring member 75 as described above, a control unit 80, a vibration generating unit 90, a localizing member 95 for localizing the treatment target, and a user interface 85 for receiving and transmitting information. The user interface 85, having e.g. a monitor and/or a keyboard, displays a list of various types of illnesses, such as for example migraine, irritable bowel syndrome (IBS), amyotrophic lateral sclerosis (ALS), rhinitis, and hypertension. A user can select one or several of the displayed illnesses by e.g. clicking or tapping on the desired type, at which the monitor may prompt for specific illness symptoms depending on the selected illness type. If the user e.g. selects 'migraine' as illness type, the monitor may ask for experienced pain level and pain location, which can be added by the user. User interface 85 may also be configured to ask for and/or to receive other information, such as e.g. subject age, gender, race, weight, length, and identity. All these parameters, i.e. illness type, symptoms, subject information such as age and gender, etc, may be referred to as 'input information' which is transmitted to the control unit 80. The control unit 80 is configured to receive the input information and, based on the input information, generate a treatment cycle, or output control signals, for controlling the operation of the vibration stimulation device 1. The treatment cycle may e.g. comprise frequency, treatment pressure, treatment duration, treatment site, type of stimulation device (or member) 1, target value for data reflecting a measure of activity in the ANS, vibration pattern, and amplitude of the vibrations. The frequency of the treatment cycle may e.g. be comprised within the interval of 10 to 100 Hz, and the treatment pressure, i.e. the time average pressure between the vibration stimulation device 1 and tissue during the vibration stimulation, may be comprised within the interval of 20 to 120 mbar. The control unit 80 is further configured to operate the vibration stimulation device 1 in accordance with the treatment cycle, for example by means of a vibration generating unit 90. The control unit 80 is also configured to return the generated treatment site to the monitor, from which the user may receive instructions on where and how to position the vibration stimulation device 1 on or in the patient 100. As the vibration stimulation device 1 has been positioned at the treatment site, the user may confirm the placement via the user interface 85. The confirmation is transmitted to the control unit 80, which then initiates the treatment in accordance with the generated treatment cycle.

During the treatment, the vibration stimulation device 1 provides vibrations having an initial frequency and amplitude and with an initial pressure to the tissue of the subject 100. The effect of the vibration treatment is continuously, periodically or intermittently monitored by monitoring member 75 that collects input data reflecting a measure of activity in the ANS of the subject 100. The monitoring member 75 may also comprise a signal processing module that filters and processes the initially monitored data, according to signal processing methods that are commonly known in the art. Alternatively, the monitoring member 75 may be connected to a separate signal processing module or the control unit 80 comprises a signal processing module. Consequently, the control unit 80 may receive raw data or processed data from the monitoring member 75, reflecting the activity of the ANS in the subject 100.

The control unit 80 may comprise a memory or storage unit for storing the data received by the monitoring member 75 and/or for storing other data, such as data further processed by the control unit 80. It may also comprise a signal and/or data processing module for processing raw data and/or for further processing of refined data, as well as a central processing unit (CPU). In one embodiment the control unit 80 is a microprocessor comprising suitable peripheral I/O capability executing software e.g. for analyzing the input data. Other types of hardware, e.g. a personal computer, may also be used for the control unit 80

Importantly, the control unit 80 is configured to control and/or to modulate one or more treatment cycle parameters, such as vibration frequency, vibration amplitude, vibration duration and/or the treatment pressure between the stimulation member 2 and the stimulated tissue. In one embodiment the control unit 80 controls and/or modulates the one or more vibration stimulation parameters independent of the input data, e.g. by means of a preprogrammed vibration scheme. In a more preferred embodiment, such as exemplified in FIG. 12, the control unit 80 controls and/or modulates the one or more vibration stimulation parameters dependent on the input data (i.e. raw or refined input data) received from the monitoring member 75 18. For this purpose the control unit 80 comprises vibration control software that is arranged to, dependent on the input data from the monitoring member 75, adjust the treatment cycle in order to control the operation of the vibration stimulation device 1. The adjustment of the treatment cycle may e.g. include a modulated frequency, amplitude, treatment pressure, or duration. The control unit 80 may e.g. be adapted to compare the input data received from the monitoring member with a predefined target value, and to abort, or prolong, the vibration treatment if the target value is reached. The target value may be set to a fraction of a value representing initial input data collected at the initiation of the treatment. The control unit 80 may also be configured to determine a minimum value of one of the measures comprised within the input data, representing a minimum of activity in the ANS. The minimum value may for example represent a minimum compared with previous treatment cycles, which may be stored in the storage unit.

The control unit 80, or the vibration control software, may adjust the treatment cycle to achieve a better, optimized or maximized effect in the ANS, dependent on the input data from the monitoring member 75. The software may for instance comprise a grid type algorithm which would test combinations of vibration parameters within given boundaries, either randomly or systematically, and use the best of these. A derivative search algorithm would identify a direction in a multidimensional parameter space along which the activity changes the most and test new parameter sets along this direction. A heuristic search would use previously accumulated and codified knowledge. Heuristics could for example be a rule that says that amplitude should go down when frequency goes up so that the power is the same. Different combinations of search algorithms are also possible.

Localizing Member

In certain embodiments of the present invention the system also comprises a localizing member 95 for localizing a target site, i.e. a target ganglion, nerve or nerve fiber of the ANS, to be stimulated. Such localizing member 95 may for instance be selected from an ultrasonic scanner, a functional magnetic resonance imaging (fMRI) scanner and/or a positron emission tomography (PET) scanner and may be configured to transmit the treatment target, or target site, to the control unit 80 by which is may be converted to a treatment site that is included in the treatment cycle.

Vibration Stimulation to Affect the Activity of the ANS

Figure 14:
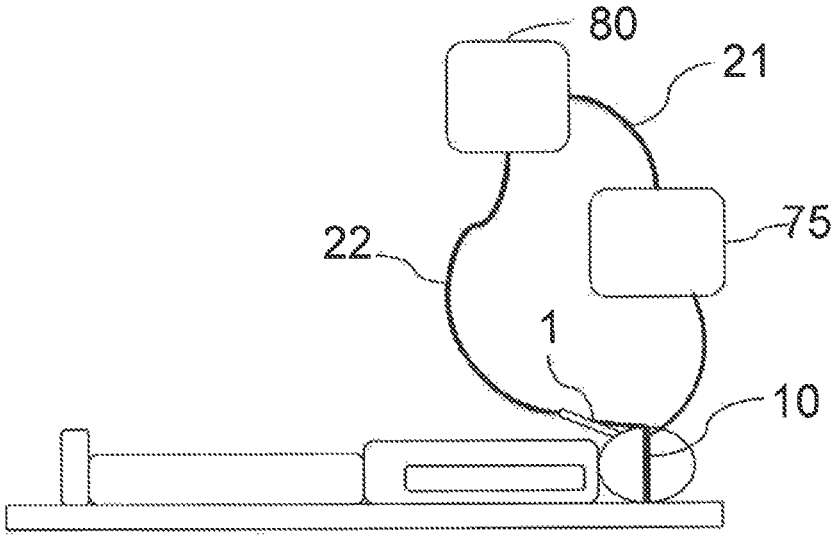
FIG. 14 is a schematic view depicting an example of use of a system according to the system aspect of the present invention.

FIG. 14 demonstrates vibration stimulation of an ANS target site of a human patient with a system according to the invention. The specific example demonstrates vibration stimulation in the nasal cavity of a human patient. A vibration stimulation device 1 is positioned by a headband 10 at a treatment site of the patient, in proximity of the ganglion, nerve, or other nerve fiber to be stimulated. The stimulation member 2 is arranged such that it abuts the tissue at the target site with a pressure that is approximately suitable for the selected ganglion and the effect to be achieved. A monitoring member 75 for monitoring a parameter related to activity in the ANS is coupled to the subject. When imparting vibrations to the target site, ANS activity is monitored by the monitoring member 75. The monitoring member 75 may provide real-time monitoring of a direct or indirect measure correlated to ANS activity, such as brain activity as measured by EEG, motor neuron activity as measured by EMG or blood pressure etc., as has been described above. Control unit 80 receives an input signal reflecting ANS activity from the monitoring member 75 via line 21.

The control unit 80 may comprise a data collection module for obtaining the signal. A signal processing module, a data processing module and a data analysis module may moreover be provided within the control unit. The control unit 80 may also receive information on vibration parameters from the vibration stimulation device 1 via line 22. The control unit may via the same line 22 output instructions, i.e. a treatment cycle, for controlling the vibration stimulation device 1. Such instructions may be based on analysis of the input signal obtained from the monitoring device and input information about the illness and/or the patient, and aims at adjusting any one of the parameters of pressure, vibration frequency or amplitude.

Figure 15:
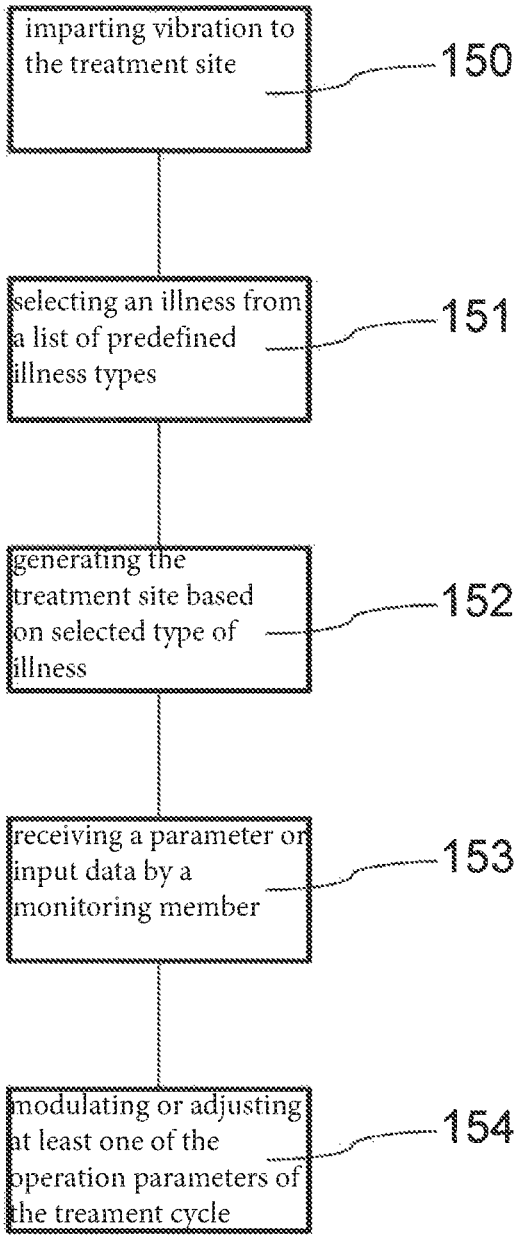
FIG. 15 is a flow chart indicating the steps comprised in one embodiment of a method for stimulation of ANS according to the present invention.

A method for establishing a vibration treatment scheme for stimulating the ANS by vibration stimulation of a treatment site that is in proximity of a ganglion or other ANS nerve or nerve fiber is exemplified below with reference to FIG. 15.

Input information comprising type of illness is provided 151, e.g. by the user interface 85 prompting the user to select 151 an illness from a list of predefined illness types, which list is displayed on the user interface 85. A treatment cycle, comprising a vibration frequency, treatment pressure, and treatment site is generated 152 based on the selected type of illness, e.g. by using a look-up table. A vibration stimulation device 1, configured to impart vibrations to the treatment site is provided 150. The treatment site for the vibration stimulation may be generated 152 based on the treatment or effect that it is desired to achieve. For certain conditions the treatment site is known and easy to locate at the body of the subject. For instance, when treatment of migraine or cluster headache is desired the treatment site to be selected may be the nasal cavity. For other conditions the target site, i.e. the target ganglion, nerve, or nerve fiber of the ANS, must be first be selected, the treatment site then being selected in close proximity to the target site. For instance, when treatment of IBS or Crohn's disease is desired one of the ganglia in the solar plexus may be the target ganglion and the target site. In order to select a corresponding treatment site it may first be necessary to locate the specific target ganglion in the subject. This may for instance be done by use of a localizing member 95, such as an ultrasonic scanner, a functional magnetic resonance imaging (fMRI) scanner and/or a positron emission tomography (PET) scanner. Once the target site, i.e. the target ganglion, has been located, the treatment site for the vibration stimulation, on or in the body of the subject, is selected and is displayed by the user interface 85.

The stimulation device 1 is anchored such that it abuts the selected treatment site, i.e. the surface of the tissue at the treatment site with a suitable pressure. Subsequently, the placement of the stimulation device 1 may be confirmed by the user by e.g. clicking a 'Confirm positioning' button on the user interface 85. The stimulation device 1 may then be operated, or brought to vibrate, to stimulate the target ganglion, nerve, or nerve fiber of the ANS or the hypothalamus. In some instances, where applicable, the stimulation member abuts the surface of the tissue at a relatively high pressure when initiating the stimulation. After an initial phase of stimulation, the pressure exerted on the surface of the tissue may be lowered. This relatively lower pressure may be used for the remaining stimulation period, provided that the measure of ANS activity changes in the desired way.

During the vibration stimulation a monitoring member 75 is used to receive 153 a parameter, or input data, that is correlated with activity in the ANS and/or to collect input data of such a parameter. The parameter may for instance be related to the pressure between the tissue at the treatment site and the vibration stimulation device 1, the electrical conductivity of the tissue, the compliance of the tissue, the pupil size of the subject, an electroencephalographic (EEG) signal derived from the subject, an electromyographic (EMG) signal derived from the subject, an electrocardiographic (ECG) signal derived from the subject, the blood flow, blood volume pulse and/or oxygen level in the blood of the subject as measured by a photoplethysmographic sensor, the blood pressure of the subject and/or body temperature of the subject. The input data may also be collected prior to the vibration treatment.

Optionally and preferably at least one of the operation parameters of the treatment cycle, i.e. vibration frequency, vibration amplitude, vibration duration and pressure between the tissue and the stimulation member 2, is modulated, or adjusted 154, dependent on the monitored parameter. If, for example, the desired effect on the ANS is not achieved, or is achieved at a lesser or higher degree than desired, any of the operation parameters of the treatment cycle may be adjusted in order to achieve the desired effect. The purpose of monitoring is to make sure that the treatment is effective. The goal is to affect a change in the activity of the ANS, i.e. both increased and decreased activity can be the intention of the treatment.

Thus, in one embodiment, a first step of monitoring and modulating is to monitor the activity level in the ANS before the vibration stimulation is started. In a second step, the vibration stimulation is applied with an initial set of vibration parameter. In a third step, the change in activity is monitored. If the change is considered to be too small a new parameter set is tried. After a few iterations a suitable parameter set is arrived at or it is concluded that treatment was not possible. If the device is able to change the activity level the treatment proceeds either for a given time or as long as the change in activity level is above a threshold value. An alternative case is where the pathology is more well-known and the activity measures have known good (or normal) values, e.g. hypertension or heart arrhythmia. In such a case the treatment can stop when an absolute value is attained. There are many ways to change the parameters to achieve better effect; a grid type algorithm would test combinations within given boundaries (either randomly or systematically) and use the best of these, a derivative search algorithm would identify a direction in a multidimensional parameter space along which the activity changes the most and test new parameter sets along this direction; a heuristic search would use previously accumulated and codified knowledge. Heuristics could for example be a rule that says that amplitude should go down when frequency goes up so that the power is the same. Different combinations of search algorithms are also possible.

When the desired effect on the ANS activity is achieved, the stimulation is suitably terminated.

It is contemplated that ANS stimulation may be performed with at least one stimulation member at at least a first treatment site of the human subject. For example, one system according to the first aspect may be used for single stimulation at one treatment site only or for sequential stimulation at two treatment sites. In another example, two or more vibration stimulation devices may be used for simultaneous vibratory stimulation at two or more treatment sites. It should be understood that pressure and vibration frequency may be the same or different for sequential and/or simultaneous stimulation at the two or more treatment sites. Two different vibration frequencies with a phase and/or amplitude difference may be applied during simultaneous stimulation to achieve an interference effect.

Prior to stimulation, the method may involve selecting from a plurality of vibration stimulation devices 1 comprising stimulation members having individually different geometry, depending on the treatment site and the physical attributes of the subject.

In addition, the duration of the treatment suitable for the patient in question may be selected prior to initiating the vibration stimulation. Such selection may comprise selecting a minimum duration for standard stimulation, such as at least 5 minutes in total. Alternatively, the treatment duration may be defined as the period of treatment after the measure of ANS activity has fulfilled a predetermined requirement. Such as after a first threshold, or target value, is reached, stimulation may continue for yet another 2-5 minutes. Other treatment regimes involve selecting a duration of treatment at a first and/or second treatment site.

The selection of the type of stimulation device and the duration of the treatment may e.g. be performed by the control unit, based on the received input information.

With reference to FIG. 16A-D, specific examples of stimulation procedures according to the system and method aspects of the present invention will be discussed. FIG. 16A-D represent examples of how stimulation may be conducted and controlled.

Figure 16A:
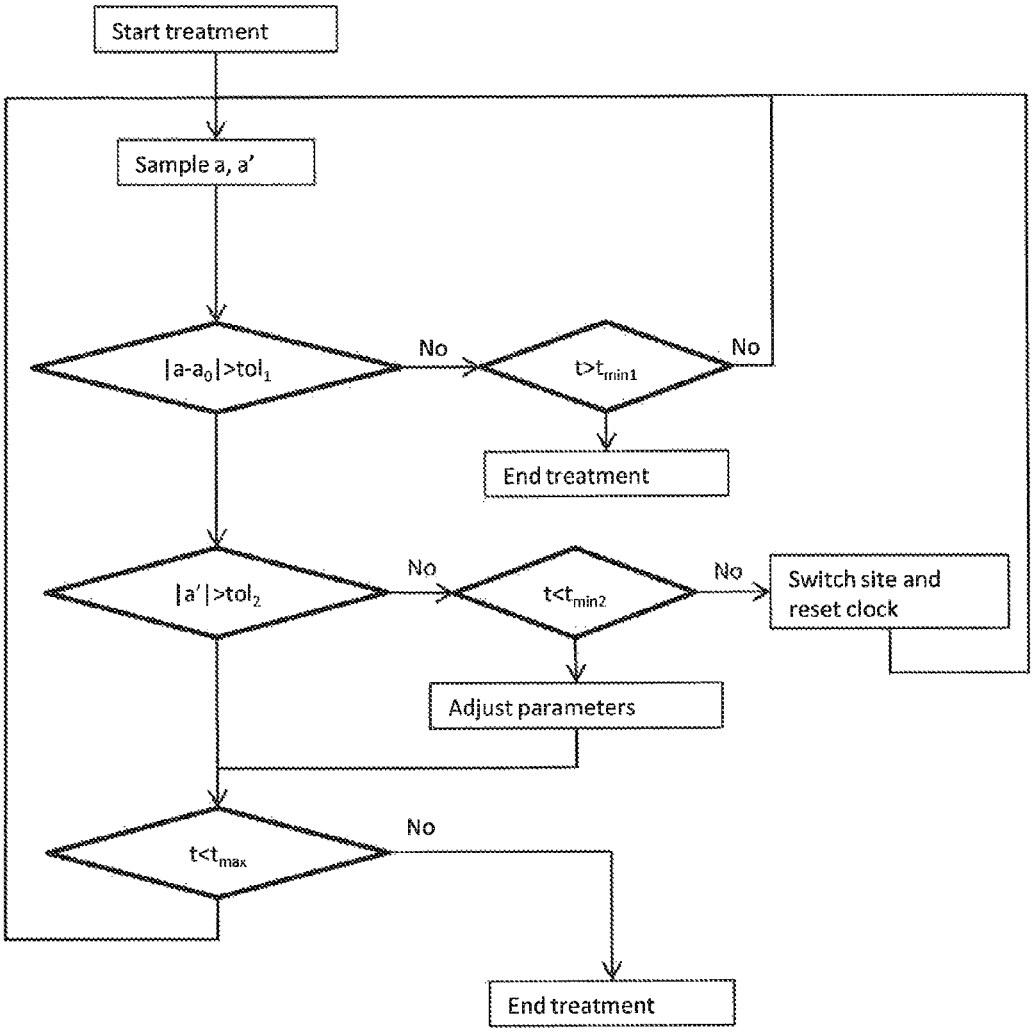
FIG. 16A-D are flow charts showing examples of treatment procedures according to the system and method aspects of the present invention.

With reference to FIG. 16A, an input signal reflecting a measure of ANS activity (a) is collected after initiating the stimulation. When the absolute value of the difference between the activity measure (a) and a desired activity ($a_0$), i.e. $|a-a_0|$, is large and thus exceeds a first threshold ($tol_1$), the absolute value of a calculated time derivative (a') of the activity measure (a) is compared to a second threshold ($tol_2$). Should the absolute value of a calculated time derivative (a') exceed the second threshold ($tol_2$) stimulation may be continued and the next cycle is initiated by collection of a new activity measure, provided that a maximum stimulation time has not been reached. When the maximum stimulation time ($t_{max}$) is reached, stimulation is terminated regardless of the current activity measure.

When the absolute value of the difference between the activity measure (a) and a desired activity ($a_0$) does not exceed a first threshold ($tol_1$), the ANS activity has practically reached the desired level. Provided that the stimulation time exceeds the minimum stimulation time ($t_{min1}$), stimulation may be terminated. If not, stimulation is continued with the same parameter set until the minimum stimulation time is reached.

When the absolute value of a calculated time derivative (a') does no longer exceed the second threshold ($tol_2$), i.e. when the measure is not changing that much, stimulation may be continued but the parameter set adjusted. Adjustment of parameters such as frequency, amplitude and pressure is done provided that the stimulation time does not exceed a second minimum stimulation time ($t_{min2}$). If the second minimum stimulation time ($t_{min2}$) has been reached, the stimulation may be continued at a second treatment site and the clock should be reset.

Figure 16B:
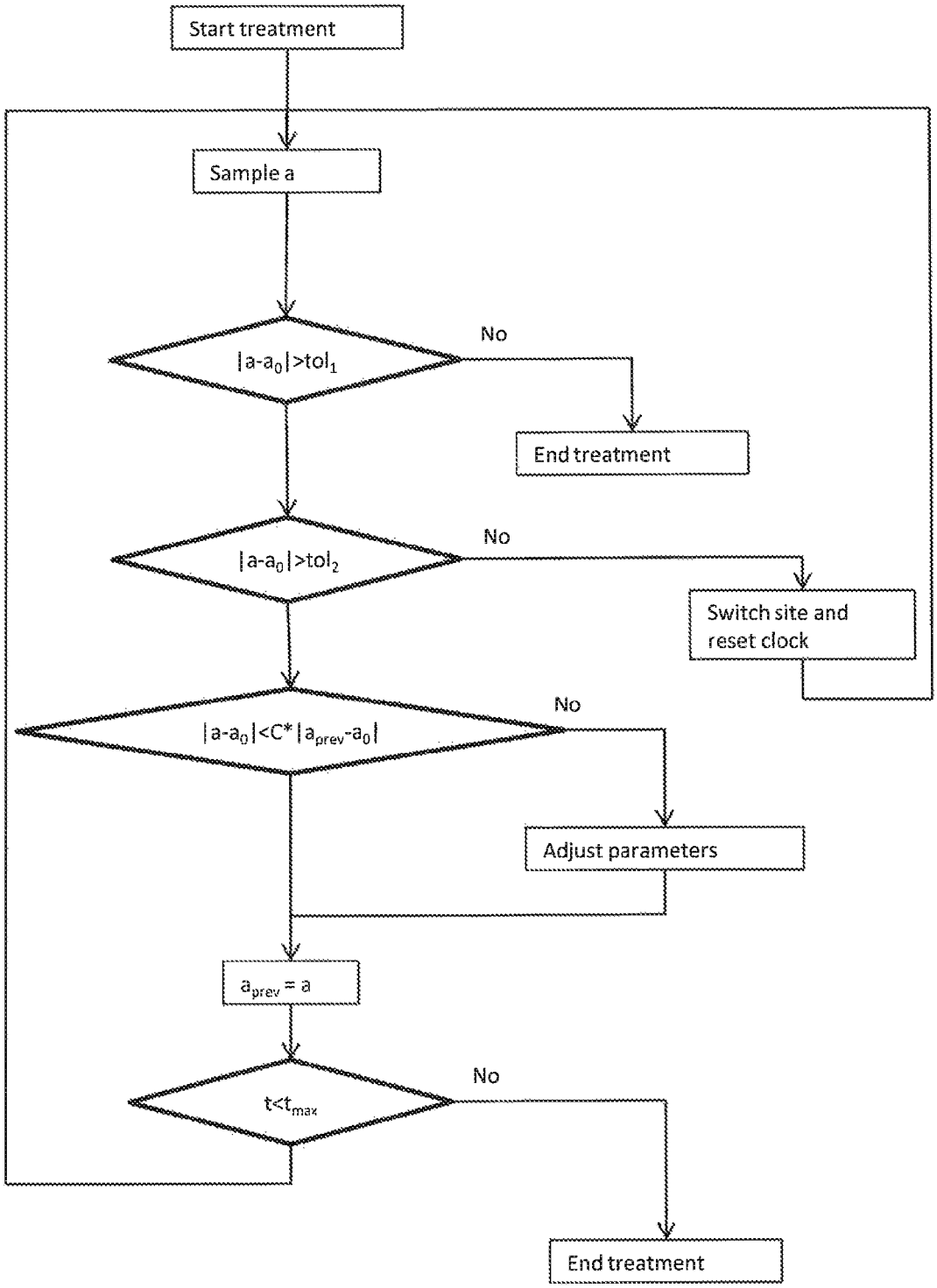

FIG. 16B represents another example of how ANS stimulation can be systematically performed. In similarity to FIG. 16A, an input signal reflecting a measure of hypothalamic activity (a) is collected after initiating the stimulation. When the absolute value of the difference between the activity measure (a) and a desired activity ($a_0$) is large and thus exceeds a first threshold ($tol_1$), the same absolute value of the difference between the activity measure (a) and a desired activity ($a_0$) is compared to a second threshold ($tol_2$). If the absolute value $|a-a_0|$ also exceed the second threshold ($tol_2$), a third comparison is made. The same absolute value is compared to the absolute value of the difference between a previous activity ($a_{prev}$) measure and the desired level of activity ($a_0$) multiplied by a constant (C), ($C*|a_{prev}-a_0|$). If the absolute value $|a-a_0|$ is less than $C*|a_{prev}-a_0|$, then the activity measure is changing in the desired direction. This means that the current activity measure is closer than the previous measure to the desired activity. Provided that the maximum stimulation time ($t_{max}$) has not been reached, the cycle is iterated once again. Before start of the next cycle, the current activity measure is stored as $a_{prev}$. If the $t_{max}$ on the other hand has been reached, the stimulation is terminated.

Should the activity measure (a) on the other hand be close to or the same as the desired activity ($a_0$), i.e. when $|a-a_0|$ is less than the first threshold, the stimulation is terminated. Similarly, should $|a-a_0|$ be less than the second threshold, the stimulation is terminated at the first treatment site and continued at a second treatment site. A new cycle may thus be initiated according to the same scheme and the clock is reset.

Should the absolute value of the difference between the activity measure and the desired activity on the other hand be larger than the corresponding difference with a previous activity measure, i.e. $C*|a_{prev}-a_0|$, the ANS activity has not changed as desired. The constant C constitutes one example of a threshold tolerance as defined herein. The parameter set is thus adjusted before start of the next cycle, the current activity measure is stored as $a_{prev}$ and the stimulation time is compared to $t_{max}$.

Figure 16C:
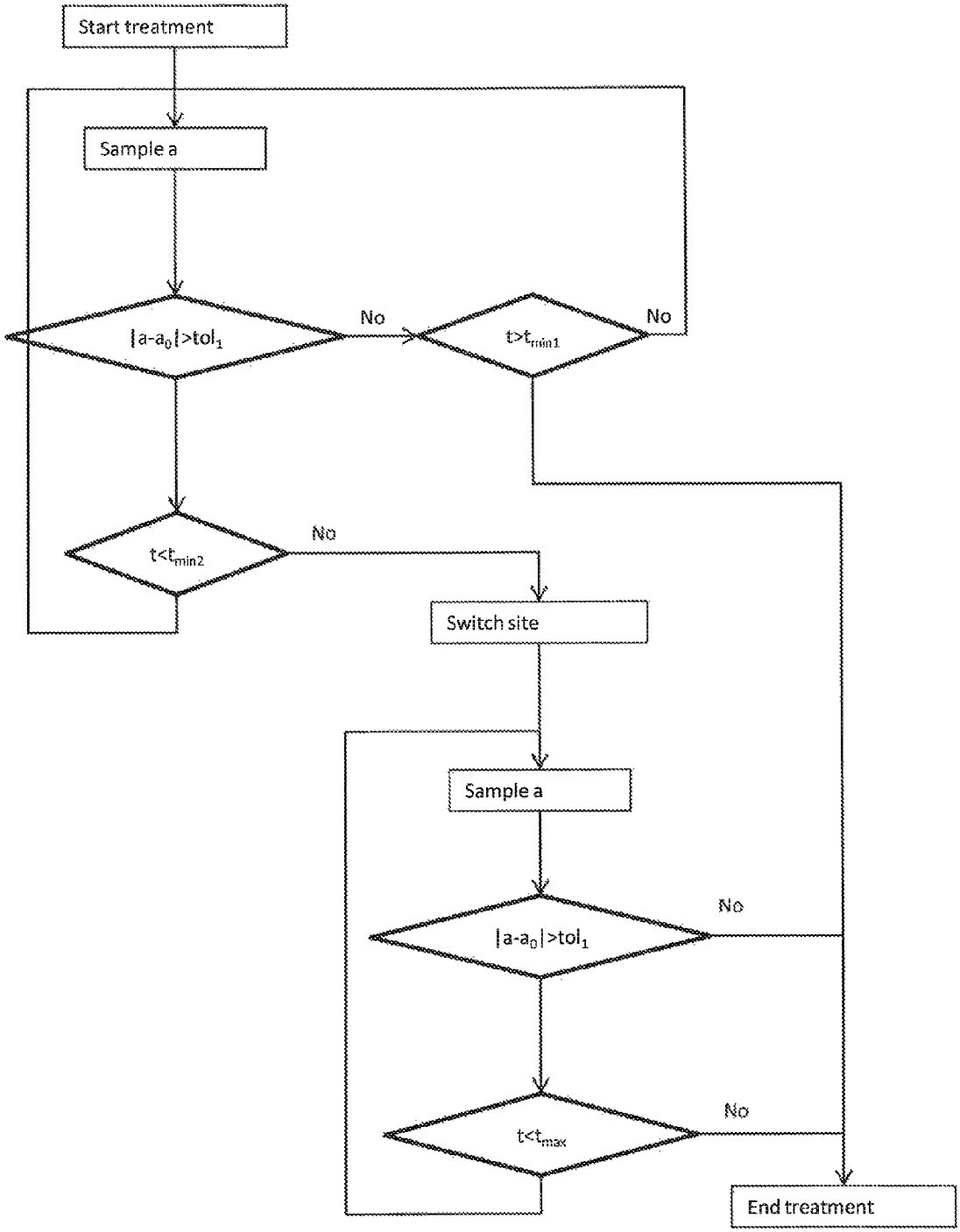

A further example of a stimulation procedure is depicted in FIG. 16C. In similarity to FIGS. 16A and B, an input signal reflecting a measure of ANS activity (a) is collected after initiating the stimulation. The absolute value of the difference between the activity measure (a) and a desired activity ($a_0$) is compared to a first threshold ($tol_1$), and if it does not exceed $tol_1$, stimulation is terminated provided that the first minimum stimulation time ($t_{min1}$) has been reached. If it does exceed $tol_1$ and the second minimum stimulation time ($t_{min2}$) has not been reached a new cycle is initiated. If however the second minimum stimulation time has been reached stimulation at the first treatment site is terminated and stimulation is continued at the second treatment site. This is done without resetting the clock. Stimulation now continues either until the desired activity level or the maximum stimulation time ($t_{max}$) has been reached.

Figure 16D:
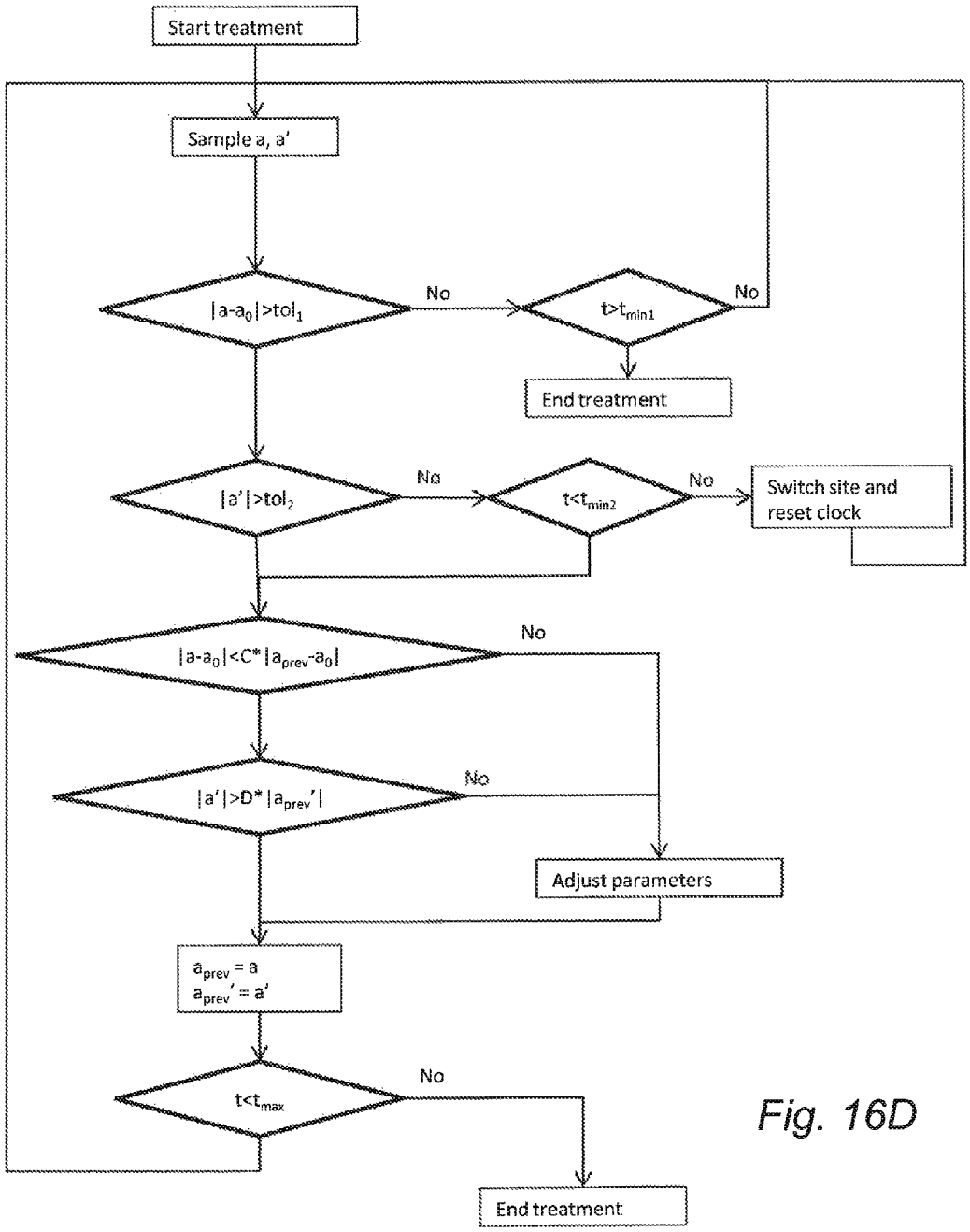

In FIG. 16D, another example of a stimulation procedure is showed. An input signal reflecting a measure of ANS activity (a) is collected and its time derivative (a') is calculated. Similarly to the procedure in FIG. 16C, the absolute value of the difference between the activity measure (a) and a desired activity ($a_0$) is compared to a first threshold ($tol_1$), and if it does not exceed $tol_1$, stimulation is terminated provided that the first minimum stimulation time ($t_{min1}$) has been reached. If it does exceed $tol_1$, the absolute value of a calculated time derivative (a') of the activity measure (a) is compared to a second threshold ($tol_2$). Should the absolute value of a calculated time derivative (a') not exceed the second threshold ($tol_2$) and a second minimum stimulation time ($t_{min1}$) has been reached, then the stimulation is terminated in at a first treatment site and continued at a second treatment site while resetting the clock. Otherwise, the absolute value $|a-a_0|$ is compared to the absolute value of the difference between a previous activity ($a_{prev}$) measure and the desired level of activity rev, ($a_0$) multiplied by the constant C, ($C*|a_{prev}-a_0|$). If the absolute value $|a-a_0|$ is larger than $C*|a_{prev}-a_0|$, the stimulation parameters should be adjusted since the activity measure is changing in the wrong direction. If the absolute value $|a-a_0|$ is smaller than $C*|a_{prev}-a_0|$, then the activity measure is changing in the desired direction and the time derivatives of the current and previous activity measures are compared. The constant C constitutes one example of a threshold tolerance as defined herein. When jail is not larger than $D*|a_{prev}'|$, wherein D is a constant, the stimulation parameters should be adjusted since the activity measure is not changing fast enough. When $|a'|$ is larger than $|a_{prev}'|$, another stimulation cycle may be initiated. However, before initiating the next cycle, the current activity measure, as well as its derivative, replaces the previous activity measure, as well as its derivative. In addition, another cycle may only be continued if the maximum stimulation time has not been reached. If the maximum stimulation time is reached, stimulation is terminated.

Figure 17A:
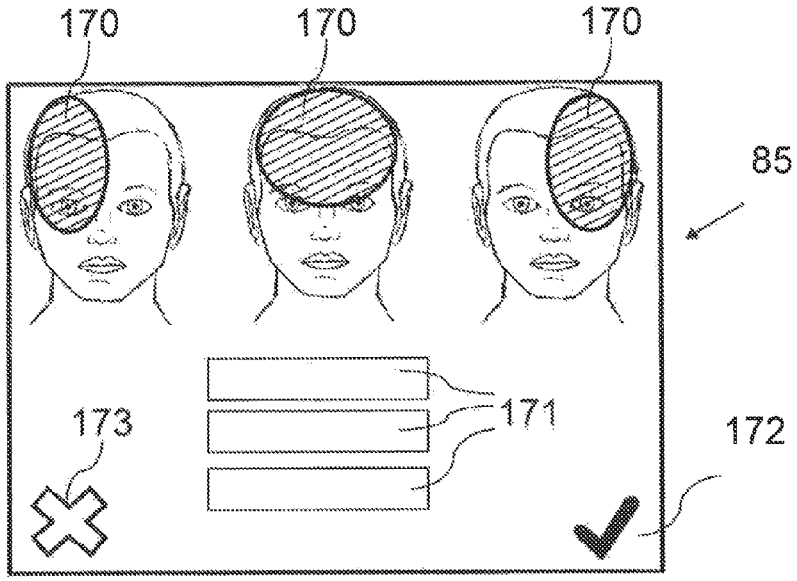
FIG. 17A-B are a schematic view depicting an example of a graphical user interface a system according to the system aspect of the present invention.
Figure 17B:
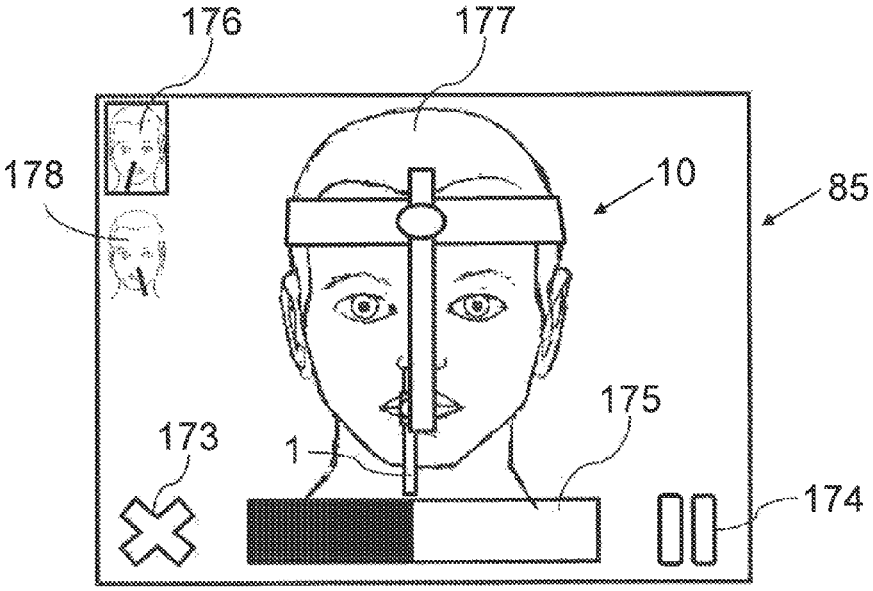

In FIG. 17A-B an example of a user interface 85 is depicted by a graphical user interface comprising a plurality of graphical objects that may be adapted to both receive and display information. As shown in FIG. 17A, the patient or any other user may provide the graphical user interface with information related to pain location by selecting one of three objects 170 wherein the location of the pain is illustrated with a shaded area. The selection may be performed by e.g. clicking with a mouse pointer or tapping on the screen. Information related to e.g. the identity of the patient, an identity of the treatment, or other suitable information, may be displayed by the text fields 171. The depicted user interface may also comprise a confirmation button 172 and a stop-button 173 for exiting the application.

In FIG. 17B, another example of a graphical user interface 85 is shown. In this example, instructions to the user on how to arrange the vibration device 1 and the anchoring member 10 are provided by an illustrated picture 177. The current position of the vibration device 1 is also indicated by a framed object 176. The objects 176 and 178 indicate the treatment cycles, and corresponding treatment sites, to be administered to the patient in a current treatment session. The framed object 176 indicates the current treatment cycle being administered to the patient. The object 178 thus indicates the treatment cycle that will follow after the end of the current treatment cycle. The progress of the treatment cycle may be illustrated by a progress bar 175, representing the total treatment duration and progress of the treatment. The treatment may also be aborted by clicking the stop-button 173 or paused by clicking the pause button 174.

Uses of the Vibration Stimulation Device

The device of the present invention may be used to affect a subject's ANS. It may be used to simply modulate the activity of the ANS of a healthy subject, e.g. to reduce stress or invoke arousal. It may also be used to treat a condition or disease associated with the ANS. Such conditions include headaches, constipation, rapid heartbeats, feelings of anxiety, dizziness, migraine and cluster headache. Diseases that may be treated include amyotrophic lateral sclerosis (ALS), Ménière's disease, Irritable bowel syndrome (IBS), gastritis, pancreatitis, gastric dumping syndrome, inflammatory bowel disease (IBD), Crohn's disease, arteriosclerosis, ankylosing spondylitis, Sjögren's syndrome, torticollis, myotonic dystrophy, diabetes mellitus, ulcerative colitis, primary sclerosing cholangitis, asthma, inflammatory conditions of the distal colon, fibromyalgia, lumbago, tracheobronchomalacia, and rheumatoid arthritis. Other diseases and syndromes for which the device may be used include postural orthostatic tachycardia syndrome (POTS), inappropriate sinus tachycardia (IST), vasovagal syncope, mitral valve prolapse dysautonomia, pure autonomic failure, neurocardiogenic syncope (NCS), neurally mediated hypotension (NMH), orthostatic hypertension, autonomic instability and a number of lesser-known disorders such as cerebral salt-wasting syndrome. Dysautonomia is also associated with Lyme disease, primary biliary cirrhosis, multiple system atrophy (Shy-Drager syndrome), Ehlers-Danlos syndrome (EDS), and Marfan syndrome.

Disorders that can be treated via the nasal cavity include migraine, cluster headache, rhinitis, ALS, IBS, Sjögren's syndrome, torticollis, myotonic dystrophy, diabetes mellitus type 2, and Ménière's disease.

Rhinitis may e.g. be treated via the nasal cavity using a system according to the present invention, which system has a vibration stimulation device, e.g. a device according to FIG. 1A-B, that can be arranged in a first state in which it can be introduced via a nostril into the nasal cavity, and a second state in which the vibration stimulation device is expanded to a volume such that the vibration stimulation device abuts against the tissue within the nasal cavity. The treatment cycle may comprise a vibration frequency within the range of 50 to 70 Hz, preferably 68 Hz, and a time average treatment pressure within the range of 50 to 80 mbar, preferably 65 mbar. The vibration stimulation may be performed during 7 to 10 minutes, preferably 9 minutes. The vibration stimulation may be administered to the right and left nasal cavity respectively. For rhinitis, the input information may comprise the illness symptom of stuffiness, itching, secretion, and sneezing.

Migraine, ALS, IBS, and hypertension may also be treated via the nasal cavity by the system and vibration stimulation device as described with reference to the treatment of rhinitis. For such treatments, the treatment cycle may comprise a vibration frequency within the range of 60 to 70 Hz, preferably 68 Hz, and a time average treatment pressure within 90 to 105 mbar, preferably 95 mbar. The vibration stimulation may be performed during 10 to 20 minutes, preferably 15 minutes, and may be administered to the left and right nasal cavity respectively. For migraine, the illness symptoms may comprise e.g. experienced pain level and pain location. Muscle weakness and decreased function in the legs are example of symptoms for ALS. For IBS the illness symptoms may comprise e.g. constipation. Hypertension involves high blood pressure. It will however be appreciated that the treatment as described above also may be applicable to symptoms including a low blood pressure.

ALS may also be treated by vibration stimulation of the neck, preferably between the trapezius muscle and the sternocleidomastoid muscle (occipital triangle), using a system comprising a stimulation device having a shape of a balloon, a bag, a pouch, or a membrane, and a diameter of 75 mm, for example a system according to FIG. 9B. The treatment cycle may comprise a frequency of 30 to 50 Hz, preferably 40 Hz, and a treatment pressure of 40 to 60 mbar. The treatment duration may be 10-20 minutes and the treatment may be administered to each side of the neck. This treatment may be related to illness symptoms such as difficulty swallowing.

Disorders that can be treated via solar plexus include ulcerative colitis, IBS, diabetes mellitus type 1, primary sclerosing cholangitis, and Crohn's disease.

IBS may be treated via the abdomen by using a treatment site positioned centrally over the abdomen, preferably the umbilical region or a treatment site located above the celiac plexus, and a system according to the present invention, which system has a vibration stimulation device having a shape of a balloon, a bag, a pouch, or a membrane, for example a system according to FIG. 8A-D. It may be attached to an anchoring member being an inflatable cuff or belt configured for anchoring the vibration stimulation device to the treatment site, alternatively a weight can be provided on top of the stimulation device. For symptoms of for example constipation and diarrhoea, a stimulation device having a diameter of 75 mm positioned over the celiac plexus may be used with a treatment cycle comprising a vibration frequency within the range of 30 to 50 Hz, preferably 40 Hz, a time average treatment pressure within the range of 40 to 60 mbar, and a treatment duration of 20 minutes. For symptoms of for example bloating, a larger vibration stimulation device having a diameter of 200 mm placed centrally over the umbilical region may be used with a treatment cycle comprising a frequency within 30 to 50 Hz, preferably 40 Hz, a treatment pressure of 20 to 30 mbar, and a treatment duration of 10 minutes.

IBS may also be treated by vibration stimulation of the intestines using a system according to an embodiment of the present invention. For such treatment, a treatment cycle may be used which comprises a frequency within the range of 10 and 70 Hz, and a treatment pressure of 20 to 50 mbar.

Disorders that can be treated via the back include ankylosing spondylitis, asthma, inflammatory conditions of the distal colon, fibromyalgia, and lumbago.

Disorders that can be treated via arm or leg vibrational stimulation include ALS, arteriosclerosis and rheumatoid arthritis.

The device of the present invention may further be used with endotracheal tubes, e.g. during surgery of the larynx.

Treatment of ALS

As disclosed herein, amyotrophic lateral sclerosis (ALS) can be treated with vibration stimulation. The indication so far is that this type of treatment can stop the degradation of bodily functions and in some cases also restore impaired functionality. The mechanism is not fully understood but a hypothesis is that improved blood flow carrying oxygen and nutrients to the nerves can stop the degradation. Different treatment sites may be used to treat different parts of the body.

Vibrations imparted to the nasal cavity have proven effective for patients with decreased function in the legs. Patients are treated at 68 Hz for 15 minutes in each nasal cavity at an average pressure in the range 70-120 mbar. Stimulation is essentially the same as when treating migraine. Initially patients tend to not perceive any effect from the treatment but after about two weeks improved functionality is reported. The improvement seems to last for a few months before the degradation starts again. This can be alleviated by another treatment session.

Treatment via the nasal cavity does not seem to improve the ability eat. Patients being helped in the sense that they get better control over their legs report unchanged or increased problems in eating. However, if vibrations are administered to the neck, in particular between the trapezius muscle and the sternocleidomastoid muscle, a part of the anatomy sometimes referred to as the occipital triangle, this condition can be improved. The idea is to stimulate the vagus nerve, responsible among other things for controlling the muscles used when swallowing. To this end the stimulation member may consist of a pillow formed inflatable rubber balloon, about 75 mm in diameter. The stimulation member may be kept in place with the aid of a non-elastic bandage with Velcro for size adjustment. The frequency used is about 40 Hz, Higher frequencies have been tested but this seems to result in a burning sensation in the skin. Treatment is administered for 10 to 15 minutes on each side of the neck. Average pressure in the stimulation member during treatment is 40-60 mbar.

Treatment of IBS

To treat IBS it turns out that vibration stimulation can be administered to the nasal cavity, to the abdomen and/or to the intestines. Selection of treatment site depends on how advanced the medical condition is. Less severe conditions can be treated by stimulating tissue in the nasal cavity. Where inflammation has developed treatment via direct stimulation of the intestines is better. IBS is often hard to diagnose in a detailed way and patients often show multiple symptoms.

A smaller stimulation member (75 mm in diameter) has been utilized to stimulate the celiac plexus and in particular the celiac ganglia. The frequency used for this stimulation member was set to 40 Hz. This was based on frequency sweeps where it was found that for this frequency the vibrations propagate through the entire body and were felt in the back according to the patients. This can be interpreted as a resonance phenomenon; the impression is that the resonance peak is rather blunt, say 30 to 50 Hz. Treatment with the smaller stimulation member alleviated symptoms of constipation and diarrhea. To treat a sensation of bloating a larger (200 mm in diameter) external stimulation member has been developed. This stimulation member administers vibrations to a large part of the abdomen. The vibration frequency has been set to 40 Hz. Higher frequencies has been tested but according to the patients the stimulation is mostly felt in the skin in this case.

The treatment seems to give a re-normalization of bodily functions in that patients reporting different symptoms are helped from the same treatment regimen. It seems likely that a patient suffering from constipation has some other dysfunction than a patient suffering from diarrhea, yet they are helped by the same treatment. It is believed that the vibration stimulation affects the autonomous nervous system. Experience from treatment in the nasal cavity would seem to indicate that the treatment restores a desired balance within and/or between the two branches of the autonomic nervous system. A similar mechanism could help against IBS provided that a neuronal imbalance is a contributing factor to the disease. Since treatment of the nasal cavity has been beneficial in IBS there exists some indirect evidence that correcting such an imbalance has a positive influence.

The average pressure in the stimulation member during treatment is in the range of from about 20 to about 60 mbar. The patient is lying down during the treatment. To ensure that the vibrations are transmitted to the patient's body a weight (about 2 kg) is applied on top of the stimulation member. Taking air in or out of the stimulation member will, to a first order approximation, result in a changed contact area between the stimulation member and the patient. The total force felt by the patient will be the same but the pressure will change as the contact area changes.

A girdle may be used to hold the stimulation members in place. The counterweight is in that case applied on top of the girdle. The stimulation members are typically put in place and activated one at a time.

A typical treatment cycle might consist of the following steps:

1. The approximate location of celiac plexus is identified
2. The smaller stimulation member is applied at the identified location
3. A weight is applied on top of the stimulation member
4. The stimulation member is inflated to a pressure in the range 40 to 60 mbar
5. Vibrations are applied at 40 Hz for about 20 minutes 6. The smaller stimulation member is removed and the larger stimulation member is applied centrally over the stomach
7. The weight is applied on top of the stimulation member
8. The stimulation member is inflated to about 20 mbar
9. Vibrations are applied at 40 Hz for about 10 minutes There are some observations that indicate that it is possible to monitor the activity in the intestines by measuring the pressure within the stimulation member.

Other illnesses that might be helped by this type of treatment include gastritis, pancreatitis, gastric dumping syndrome, diabetes, Crohn's disease, ulcerative colitis, sclerosing cholangitis.

Clinical Results

Vibration Stimulation of One Patient Suffering from Migraine

Before treatment, the patient had vomited and was experiencing photophobia and nausea. The patient reported a pain level of 10 on the VAS scale. The pain was located to the right part of the head.

Treatment was performed while registering blood oxygen level dependent functional magnetic resonance images (fMRI). The patient estimated the pain before, during and after stimulation on a visual analogue scale (VAS) from 0-10, wherein 0 corresponds to no pain, and 10 corresponds to maximal pain.

The patient was treated while in a horizontal position. The vibratory treatment was started in the right nasal cavity at a pressure of 85-100 mbar. The frequency was set to 68 Hz. After 10 minutes of treatment, the pain level was down to 6 and the nausea was gone. At that point the balloon was moved to the left nasal cavity and treatment continued for another 8 minutes. At this point the patient reported a pain level of 2. After a five minute break the treatment was started again in the right nasal cavity. After about 8 minutes the pain level was down to 1 and the treatment was terminated.

Six months after the treatment the patient reported that no migraine attacks had occurred. Consequently, the effect of the stimulation was long-lasting.

Analysis of the fMRI data showed that the oxygen consumption in the hypothalamus initially was abnormally high whereas during the treatment the consumption decreased to levels similar to the surrounding brain tissue.

Vibration Stimulation of One Patient Suffering from Ménière's Disease

The patient has suffered from Ménière's disease affecting the left ear for about five years. Pharmacologic treatment has been unsuccessful and the suffering has reached a degree where the left ear is classified as deaf. The patient has been referred to destructive surgery. Before the first treatment an audiogram was registered showing an average value of 70 dB for the left ear.

During a first treatment vibrations were administered to the left nasal cavity for about 11 minutes at a frequency of 74 Hz, and then to the right nasal cavity for about the same time. During treatment of the right nasal cavity the frequency was lowered to 68 Hz. Finally the left nasal cavity was treated for about 11 minutes at 68 Hz. The pressure was in the range 90-100 mbar. A few days after the first treatment another audiogram measurement was performed showing that hearing on the left side had improved to an average value of 60 dB. The patient also reported that other ailments, a sensation of fullness in the ear and tinnitus, had been reduced.

One week after the first treatment a second treatment was administered. First 12 minutes on the right side and then 24 minutes on the left side. Pressure was in the range 90-100 mbar and frequency was set to 68 Hz. Pressure was manually adjusted during the later stages of the treatment to investigate any change in patient response. A few days later the patients hearing was assessed again, this time the average value for the left ear was 53 dB.

Vibration Stimulation of One Patient Suffering from Heart Arrhythmia

One patient suffering from the most common form of heart arrhythmia i.e. atrial fibrillation since two years had previously been treated with pharmaceuticals and electrical shock therapy on seven occasions without success. Because of this the patient was referred to ablation, a partly destructive procedure. The patient has been treated with vibration therapy on four occasions with 2, 6, and 15 weeks in between. During the last interval the patient was able to do physical exercise for the first time in two years. Treatment parameters were pressure in the range 90-100 mbar, frequency 68 Hz, treatment administered for 10 to 12 minutes in each nasal cavity.

Vibration Stimulation of Patients Suffering from ALS

Two patients suffering from ALS has been treated with vibration therapy. Treatment parameters were the same as for other conditions, i.e. 68 Hz, 90-100 mbar, 10 to 12 minutes of treatment in each nasal cavity. In both cases the patients reported improvements in their conditions. In one case the patient after several treatment sessions is again able to sneeze, something that the disease had prevented for several months. In the other case the patient reported reduced muscle contractions (fasciculations) during day time. Three weeks after the treatment the patient further reported that it is now possible to walk much further than previously and that a sense of numbness in the legs had decreased. The same patient complained about difficulties swallowing and associated loss of weight. A treatment session wherein a 75 mm diameter stimulation member was use on the neck at an average pressure of about 50 mbar and a frequency of 40 Hz for about 15 minutes on each side of the neck was performed. Two weeks after the treatment the patient reported that it was much easier to swallow and that the lost weight was being regained. Since there is no known way to cure or even slow down ALS these results are quite remarkable.

Vibration Treatment of a Patient Suffering from Migraine

The patient was suffering from a migraine attack with reported pain level of 8 on a scale where 0 means no pain and 10 maximum pain. The pain was located to the right side of the head. Vibration treatment was administered to the right nasal cavity. The frequency used was 68 Hz. The pressure was initially set to between 80 and 100 mbar. After 200 seconds the pressure was lowered to 42 mbar. The patient sensed an increase in pain level. The pressure was returned to the range 80 to 100 mbar after another 50 seconds. At 350 seconds the patient started to feel very tired. After 450 seconds of treatment a sharp miosis (constriction of the pupil) was observed. After 600 seconds of treatment the pressure was lowered again to about 40 mbar. After 700 seconds the patient reported that the pain had gone down to 4-5. The pain further decreased to 3 at 875 seconds and 2-3 at 1000 seconds. The pressure was raised again after 1050 seconds to about 90 mbar. At 1140 seconds the pain had increased slightly to 3-4. At 1200 seconds the pressure was reduced to about 40 mbar again. At 1250 seconds the pain level was 2. At 1375 seconds the pain level was 1-2. After about 1400 seconds of treatment the pressure was lowered even further to about 20 mbar. At 1475 seconds the pain level was 1. After 1500 seconds the vibrations were stopped. At 1515 seconds the pain was gone. 1600 seconds after the start of treatment the vibrations were resumed at 68 Hz, the pressure was still about 20 mbar. After another 700 seconds the treatment was terminated. The patient had no headache afterwards. Also a pain in the neck experienced prior to treatment was gone. The fatigue experienced during the treatment was also gone.

LIST OF EMBODIMENTS

1) A system for affecting the autonomic nervous system of a subject, comprising:
   a) a vibration stimulation device configured to impart vibrations to a tissue of said subject at a frequency of 10 to 100 Hz;
   b) a monitoring member for receiving input data reflecting a measure of activity in the autonomic nervous system of the subject.
2) The system according to embodiment 1, wherein said input data is selected from the group comprising:
   a measure of the pressure between said tissue and said vibration stimulation device;
   a measure of the electrical conductivity of said tissue;
   a measure of the compliance in said tissue;
   a measure of the pupil size of the subject;
   an electroencephalographic (EEG) signal derived from the subject;
   an electromyographic (EMG) signal derived from the subject;
   an electrocardiographic (ECG) signal derived from the subject;
   a photoplethysmographic signal;
   a measure of the blood pressure of the subject; and
   a measure of the body temperature of said subject.
3) The system according to any of embodiments 1-2, further comprising an anchoring member configured for anchoring the vibration stimulation device to the subject such that the vibration stimulation device abuts against the tissue of said subject.
4) The system according to embodiment 3, wherein the anchoring member is selected from the group comprising a headband, a facial mask, a pair of glasses, a belt, a cuff, a vest and an adhesive patch.
5) The system according to any of embodiments 3-4, wherein said monitoring member is at least partly integrated into said anchoring member.
6) The system according to any of embodiments 3-4, wherein said monitoring member 75 is at least partly integrated into said vibration stimulation device.
7) The system according to any of embodiments 1-6, further comprising a control member configured to control at least one vibration parameter, the vibration parameter being selected from vibration frequency, vibration amplitude, vibration duration and pressure between said vibration stimulation device and said tissue.
8) The system according to embodiment 7, wherein said control member is configured to modulate said at least one vibration parameter dependent on said input data.
9) The system according to embodiment 8, wherein said control member is configured to modulate said at least one vibration parameter such that the effect of the vibrations on said measure is maximized.
10) The system according to any of embodiments 8-9, wherein said control member comprises software implementing an algorithm that, dependent on said input data, is configured to control said modulation of said at least one vibration parameter.
11) The system according to embodiment 10, wherein said algorithm is selected from:
   a grid search algorithm;
   a gradient search algorithm; and
   a heuristic search algorithm.
12) The system according to any of embodiments 1-11, further comprising a localizing member for localizing, in said subject, a target site for vibration stimulation.

13) The system according to embodiment 12, wherein the localizing member is selected from an ultrasonic scanner, a functional magnetic resonance imaging (fMRI) scanner and/or a positron emission tomography (PET) scanner.

14) A method for affecting the autonomic nervous system of a subject, comprising the steps of:
selecting a treatment site of said subject;
anchoring a vibration stimulation device such that it abuts against said treatment site;
transmitting vibrations from said vibration stimulation device to said treatment site, said vibrations having a frequency of 10 to 100 Hz;
monitoring a measure of a parameter that is correlated with the activity in the autonomic nervous system of the subject.

15) The method according to embodiment 14, wherein said measure is selected from the group comprising:
a measure of the pressure between said tissue and said vibration stimulation device;
a measure of the electrical conductivity of said tissue;
a measure of the compliance in said tissue;
a measure of the pupil size of the subject;
an electroencephalographic (EEG) signal derived from the subject;
an electromyographic (EMG) signal derived from the subject;
an electrocardiographic (ECG) signal derived from the subject;
a photoplethysmographic signal;
a measure of the blood pressure of the subject; and
a measure of the body temperature of said subject.

16) The method according to any of embodiments 14-15 further comprising the step of:
controlling at least one vibration parameter selected from the group comprising vibration frequency, vibration amplitude, vibration duration and pressure between said vibration stimulation device and said tissue, wherein the controlling is dependent on said monitored measure.

17) The method according to embodiment 16, wherein the controlling is based on an automated algorithm.

18) The method according to embodiment 17, wherein the automated algorithm is selected from:
a grid search algorithm;
a gradient search algorithm; and
a heuristic search algorithm.

19) The method according to any of embodiments 14-18, further comprising, prior to the step of selecting a treatment site, the step of localizing a treatment target, said target being a ganglion, a nerve, or a nerve fiber of the autonomous nervous system.

20) The method according to embodiment 19, wherein said ganglion is a ganglion wherein a disorder in the autonomic nervous system has been manifested.

21) The method according to any of embodiments 19-20, wherein said treatment site is selected in order to achieve an effect at said treatment target.

22) The method according to any of embodiments 19-21, wherein said step of localizing is made using an ultrasonic scanner, a functional magnetic resonance imaging (fMRI) scanner and/or a positron emission tomography (PET) scanner.

What is claimed is:

1. A method for alleviating amyotrophic lateral sclerosis (ALS) related symptoms in a human subject comprising the steps of:
introducing a first vibration stimulation member into a posterior part of a first nasal cavity of the human subject, and anchoring the first vibration stimulation member to the head of the human subject by a pair of glasses, wherein the pair of glasses comprises a support arm, an angle adjustment member, and an attachment member, wherein the attachment member is connecting to the first vibration stimulation member;
by means of the first vibration stimulation member, imparting vibrations to the posterior part of the first nasal cavity at frequency in a range of from 60 to 70 Hz;
arranging a second vibration stimulation member between the trapezius muscle and the sternocleidomastoid muscle on a first side of the neck of the human subject; and
by means of said second vibration stimulation member, imparting vibrations to the first side of the neck at a frequency in a range of from 30 to 50 Hz.

2. The method according to claim 1, wherein said step of imparting vibrations by means of the first stimulation member is conducted prior to said step of imparting vibrations by means of the second stimulation member.

3. The method according to claim 1, wherein said step of imparting vibrations by means of the first stimulation member is conducted concurrently with said step of imparting vibrations by means of the second stimulation member.

4. The method according to claim 1, wherein said step of arranging the second vibration stimulation member further comprises the step of applying a collar around said second vibration stimulation member and around said neck of the human subject.

5. The method according to claim 1, wherein a time averaged pressure within the first vibration stimulation member during the imparting of vibrations by means of the first vibration stimulation member is in the range of from 9 to 105 mbar.

6. The method according to claim 1, wherein a time averaged pressure within the second vibration stimulation member during the imparting of vibrations by means of the second vibration stimulation member is in the range of from 40 to 68 mbar.

7. The method according to claim 1, wherein said second vibration stimulation member has a diameter in the range of from 50 to 100 mm.

8. The method according to claim 1, wherein said step of introducing the first vibration stimulation member comprises the steps of: introducing the first vibration stimulation member into the nasal cavity in an essentially non-expanded state; and expanding the first vibration stimulation member within the nasal cavity such that it abuts nasal cavity tissue.

9. The method according to claim 1, further comprising the steps of: introducing the first vibration stimulation member into a second nasal cavity; and by means of said first vibration stimulation member, imparting vibrations to a posterior part of a second nasal cavity at frequency in the range of from 60 to 70 Hz.

10. The method according to claim 1 further comprising the steps of: arranging the second vibration stimulation member between the trapezius muscle and the sternocleidomastoid muscle on a second side of the neck of the human subject; by means of said second vibration stimulation member, imparting vibrations to the second side of the neck at a frequency in the range of from 30 to 50 Hz.

11. The method according to claim 1, wherein a duration of said imparting of vibrations to the nasal cavity and/or the neck is in the range of 10 to 20 minutes.

* * * * *